US012345034B2

(12) United States Patent
Rodgers

(10) Patent No.: US 12,345,034 B2
(45) Date of Patent: Jul. 1, 2025

(54) TOILET

(71) Applicant: Trafton D. Rodgers, Lubbock, TX (US)

(72) Inventor: Trafton D. Rodgers, Lubbock, TX (US)

( * ) Notice: Subject to any disclaimer, the term of this patent is extended or adjusted under 35 U.S.C. 154(b) by 0 days.

(21) Appl. No.: 18/438,123

(22) Filed: Feb. 9, 2024

(65) Prior Publication Data

US 2024/0247474 A1 Jul. 25, 2024

Related U.S. Application Data

(63) Continuation of application No. 17/049,450, filed as application No. PCT/US2019/030441 on May 2, 2019, now Pat. No. 11,898,339.

(60) Provisional application No. 62/666,893, filed on May 4, 2018.

(51) Int. Cl.
*E03D 11/12* (2006.01)
*A47K 17/02* (2006.01)

(52) U.S. Cl.
CPC ..... *E03D 11/125* (2013.01); *A47K 17/026* (2013.01)

(58) Field of Classification Search
CPC .... E03D 11/125; A47K 17/026; A47K 17/028
USPC ..... 4/667, 254, 419, 443, 405, 406, 410, 4/300.2
See application file for complete search history.

(56) References Cited

U.S. PATENT DOCUMENTS

| | | | | |
|---|---|---|---|---|
| 3,405,411 | A | 10/1968 | Brown | |
| 3,662,407 | A | 5/1972 | Colucci | |
| 4,196,480 | A | 4/1980 | Guenther et al. | |
| 4,441,218 | A | 4/1984 | Trybom | |
| 4,726,079 | A | 2/1988 | Signori et al. | |
| 5,027,446 | A | 7/1991 | Robertson | |
| 5,090,067 | A | 2/1992 | Cogdill | |
| 5,199,113 | A | 4/1993 | Glasow et al. | |
| 5,410,471 | A | 4/1995 | Alyfuku et al. | |
| 5,730,149 | A | 3/1998 | Nakayama et al. | |
| 9,756,297 | B1 | 9/2017 | Clements | |
| 11,898,339 | B2 * | 2/2024 | Rodgers | E03D 11/125 |

(Continued)

FOREIGN PATENT DOCUMENTS

| | | | |
|---|---|---|---|
| CA | 2776856 | A1 | 11/2013 |
| CN | 106691294 | A | 5/2017 |
| JP | 2015-006650 | A | 1/2015 |

OTHER PUBLICATIONS

Oct. 28, 2019 International Search Report issued in International Patent Application No. PCT/US2019/30441.

(Continued)

*Primary Examiner* — Tuan N Nguyen
(74) *Attorney, Agent, or Firm* — Williams Mullen; R. Brian Drozd

(57) ABSTRACT

A method of operating a toilet includes detecting movement, using an imaging device comprising a sensor, of eyes of a person, wherein the imaging device is attached to or associate with the toilet. Using a computer processor analyzing imaging received from the imaging device, one or more directions that the person's eyes are pointing towards is determined. The directions are compared with prestored commands and a first prestored command is executed in response to the one or more directions matching the first prestored command.

17 Claims, 28 Drawing Sheets

(56) References Cited

U.S. PATENT DOCUMENTS

| | | | | |
|---|---|---|---|---|
| 2008/0001735 | A1* | 1/2008 | Tran | A43B 3/48 340/539.22 |
| 2010/0229293 | A1 | 9/2010 | Rodgers et al. | |
| 2015/0000025 | A1* | 1/2015 | Clements | E03D 9/08 4/443 |
| 2016/0374619 | A1 | 12/2016 | Borkholder et al. | |

OTHER PUBLICATIONS

Oct. 28, 2019 Written Opinion issued in International Patent Application No. PCT/US2019/30441.
Jan. 10, 2022 Office Action issued in Canadian Patent Application No. 3,098,863.
Aug. 11, 2022 Office Action issued in Canadian Patent Application No. 3,098,863.
Dec. 29, 2022 Office Action issued in U.S. Appl. No. 17/049,450.

* cited by examiner

TOILET

CROSS-REFERENCE TO RELATED APPLICATION

This application is a Continuation of Ser. No. 17/049,450 filed Oct. 21, 2020, which in turn is a National Stage Application of PCT/US2019/30441 filed on May 2, 2019, which claims the benefit of U.S. Provisional Application No. 62/666,893, filed May 4, 2018, which is herein incorporated by reference in its entirety.

TECHNICAL FIELD

The present disclosure generally relates to toilets and more particularly relates to systems and components associated with toilets for assisting people with disabilities or other physical limitations.

BACKGROUND

Individuals who live with a physical impairment often have difficulty performing simple, everyday tasks. Some of these tasks are imperative for everyday living, such as using a toilet. Typically, a standard toilet will be permanently affixed to a drain system and is not intended to be moved. Most standard toilets may be too high or too low for a person with a physical disability to use easily or safely. In addition, for someone confined to a wheelchair, the height of a wheelchair may not necessarily be at the same level as a toilet seat, which can cause complications when the person needs to move from the wheelchair to the toilet seat or vice versa.

To partially rectify the problem of this difference in heights, it is known to provide an attachment that can be used to increase the height of the toilet seat. This attachment can either be attached to the toilet bowl or may be a free-standing device that sits over the toilet bowl. However, this device, of course, is not adjustable by a user during use. Although this type of attachment may be adequate for some individuals who merely require a preset, raised toilet seat, this may not be a viable option for some individuals with other types of physical limitations. Therefore, there is a need for toilets and associated components that can accommodate individuals who may have special physical needs in order to provide a safe and easy-to-use way for these individuals to accomplish this essential human function.

SUMMARY

Therefore, some of the objects of the present disclosure are to provide a toilet with an adjustable height and/or a toilet lift which is safe and easy to use. For example, in some embodiments, an adjustable height feature may be realized by an elevation system that uses water line pressure to perform the lifting/lowering function. Another object of the present disclosure is to conserve water, such as by using the same volume of water for a lifting function that is also used for flushing a toilet.

These and other objects may be met by the various implementations described in the present disclosure. According to one embodiment, a toilet may include a base configured to be fastened to a floor. The toilet may also include a pair of bracket panels connected to the base, the pair of bracket panels extending upward from the floor in a vertical direction. Also, the toilet may include a tank housing confined between the pair of bracket panels and having an adjustable height above the base allowing the tank housing to move in the vertical direction between a raised position and a lowered position. The toilet may further include a bowl attached to the tank housing, the bowl configured to support the weight of a user.

According to another embodiment of the present disclosure, a toilet may comprise a tank housing configured to collect water to be used during a flushing cycle. The toilet may also include a bowl attached to the tank housing, the bowl configured to support the weight of a user. Furthermore, the toilet may include a side rail assembly including first and second side rails, a rail pivot block attached to a back portion of the bowl, and first and second pivot shafts. The first and second side rails may be connected to the rail pivot block via the first and second pivot shafts, respectively. The first and second side rails may be configured to pivot with respect to the rail pivot block between a stored position and a support position for providing support to the user.

According to yet another embodiment, an exemplary toilet may include a tank housing configured to collect water to be used during a flushing cycle and a bowl attached to the tank housing. The exemplary toilet may also include a seat arranged on an outer rim of the bowl, the bowl configured to support the weight of a user seated on the seat. Furthermore, the exemplary toilet may include one or more sensors configured to sense at least one characteristic of the user.

According to yet another embodiment, a method of operating a toilet includes detecting movement, using an imaging device comprising a sensor, of eyes of a person, wherein the imaging device is attached to or associate with the toilet. Using a computer processor analyzing imaging received from the imaging device, one or more directions that the person's eyes are pointing towards is determined. The directions are compared with prestored commands and a first prestored command is executed in response to the one or more directions matching the first prestored command.

BRIEF DESCRIPTION OF THE DRAWINGS

The embodiments of the present disclosure may be best understood by reference to the following description taken in conjunction with the accompanying drawing figures.

DETAILED DESCRIPTION

The embodiments of toilets described in the present disclosure may be installed in residential or hospital settings and are configured to assist people with physical disabilities or limitations in the regular human necessity of using a toilet. Some embodiments may include systems for adjusting a height of a toilet seat to accommodate a user in the process of getting onto or getting off of the toilet seat. A complementary feature to the height adjustment system is a collapsible drainage system and various lift systems.

Other embodiments of toilets may include sensors used with a toilet for detecting characteristics of a user, such as body temperature, heart rate, heart rhythm, etc. The sensors may include cameras for detecting features of the user or features of the waste product. Also, a seating grid sensor may be used for calculating a user's range of motion. In addition, an electronic dipstick may be incorporated in the toilet for allowing a urine test to be performed.

Still other embodiments include accessories that may be incorporated into a toilet for assisting people with disabilities and/or for allowing certain functions that may be desirable in this environment. For example, one additional accessory may include an automatic flushing and/or automatic height adjustment feature. Another accessory may include a self-releasing flushing feature to allow a flapper to fall back into place after the toilet has been flushed. Another accessory includes side rails that a user can handle for support when getting onto or off of the toilet seat. Other features include bedpan sprayer devices, foot pedals for controlling aspects of the toilet, a night light, an automated air freshener, etc.

Figure 1:
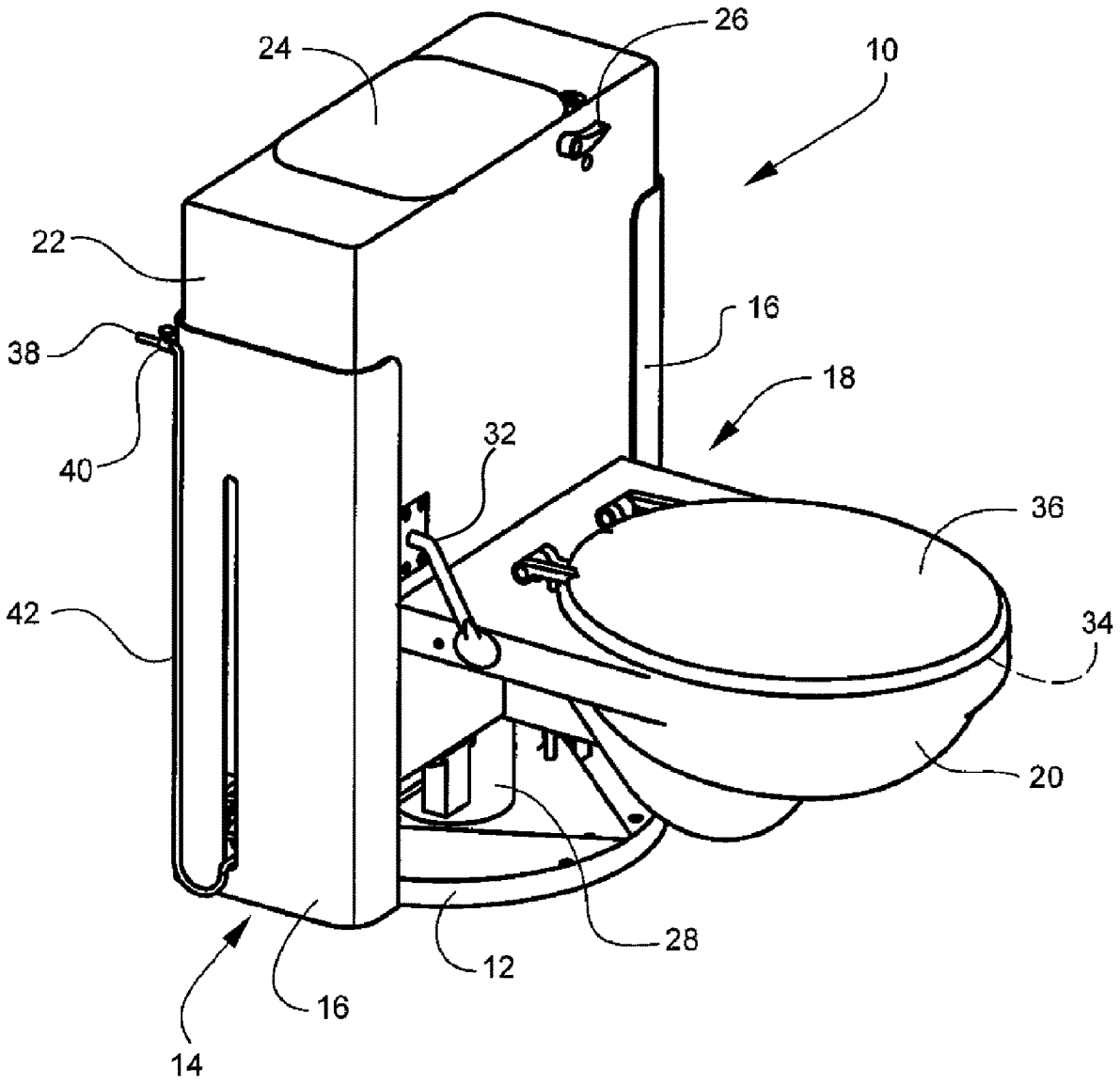
FIG. 1 is a perspective view of an adjustable toilet shown in a lowered position, according to one implementation of the present disclosure.
Figure 2:
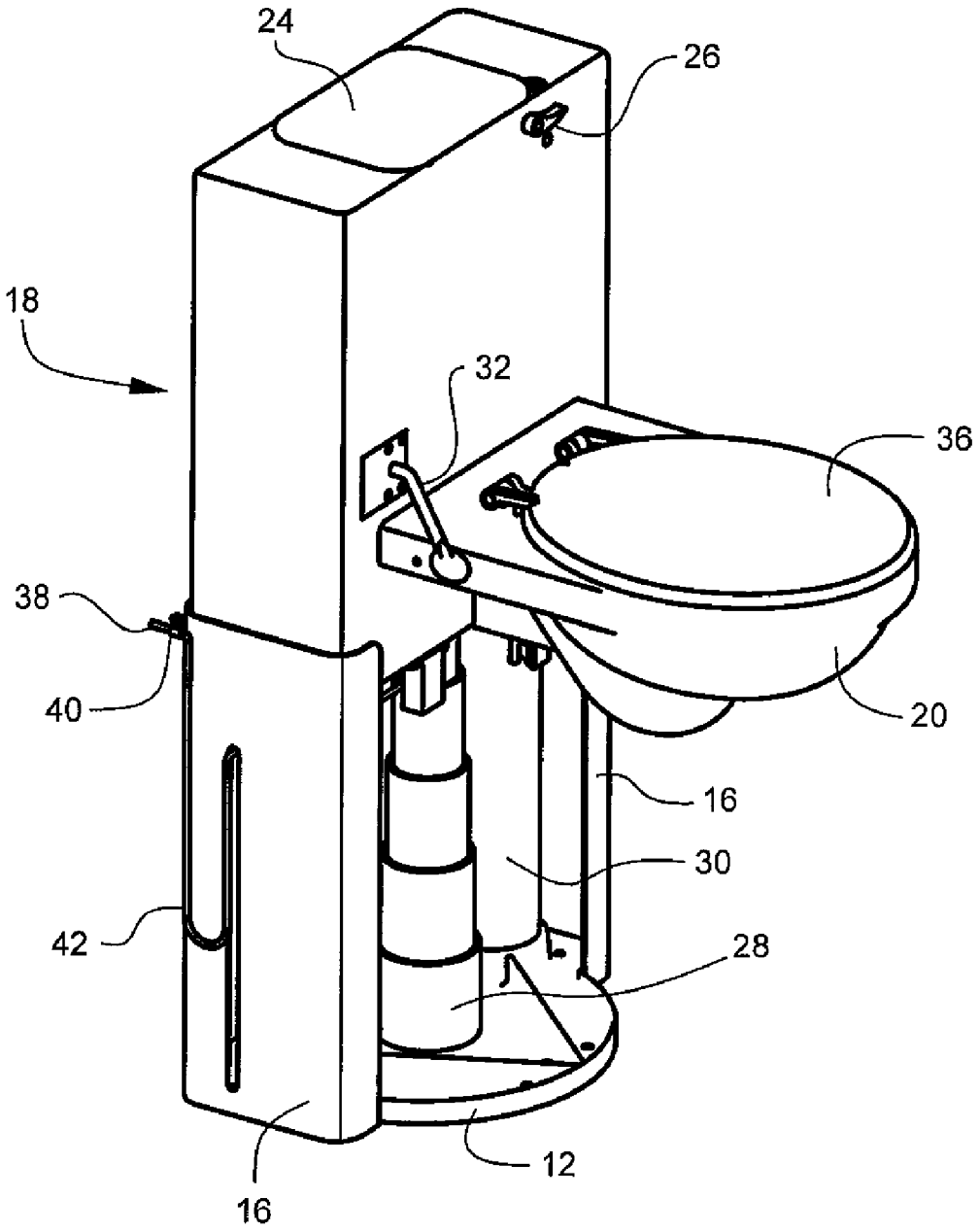
FIG. 2 is a perspective view of the adjustable toilet of FIG. 1 shown in a raised position.

FIG. 1 is a perspective view of an embodiment of an adjustable toilet 10 shown in a lowered position and FIG. 2 is a perspective view of the adjustable toilet 10 shown in a raised position. The adjustable toilet 10 includes a toilet base 12 fastened to the floor (not shown) and an upwardly-extending skirt 14 constructed of a pair of opposed, generally C-shaped panels 16, or bracket panels. The toilet base 12 carries a toilet housing 18 which includes a toilet bowl 20 and a tank housing 22. The tank housing 22 is received in and located by the skirt 14 between the panels 16 such that it can move freely up and down. The tank housing 22 includes a water tank 23 (shown in FIG. 5), a tank cover 24 on top, and a flush handle 26 for manual flush initiation. The complete toilet housing 18 can be moved between a lowered position (FIG. 1) and a raised position (FIG. 2). A collapsible drainage pipe assembly 28, as shown in detail in FIGS. 11-13, interconnects the toilet housing 18 and the toilet base 12.

Figure 3:
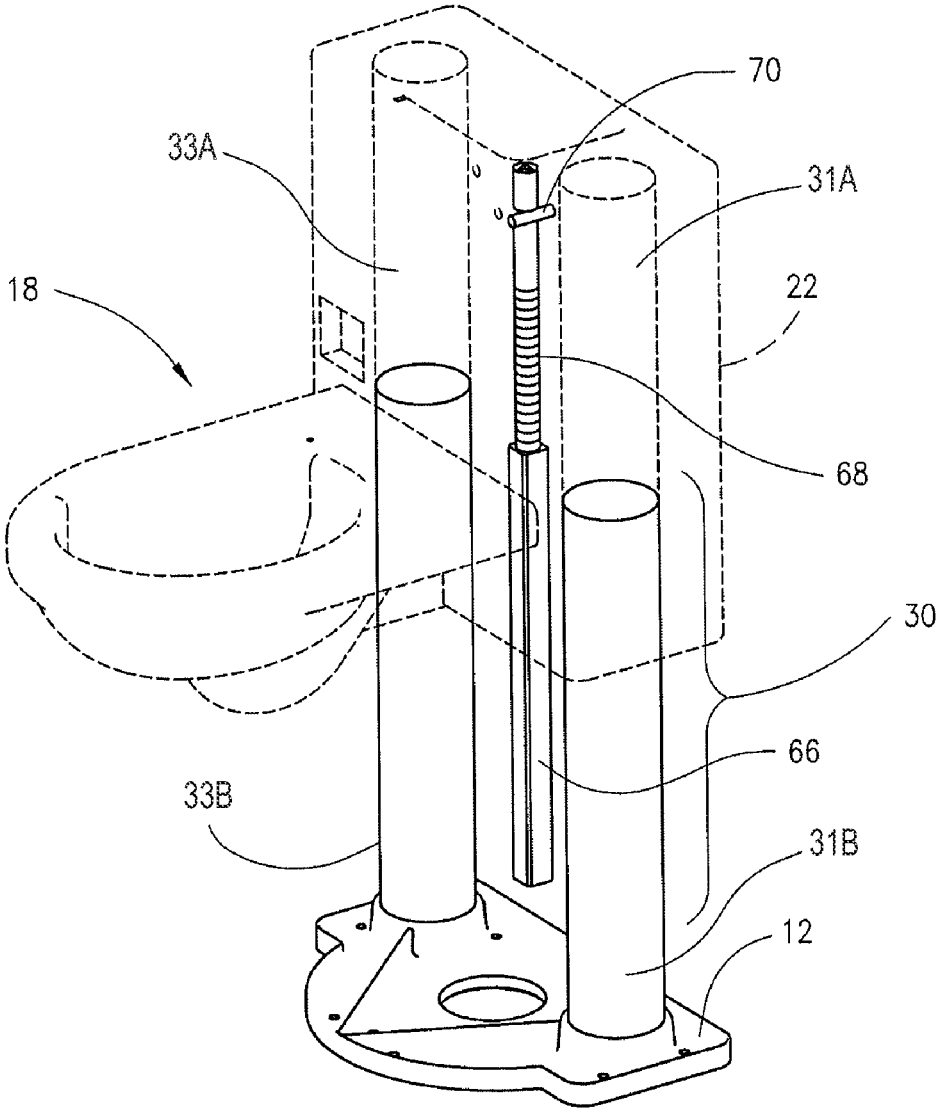
FIG. 3 is a perspective view of the adjustable toilet of FIG. 1 showing details of portions of a height adjustment system, according to one implementation of the present disclosure.
Figure 4:
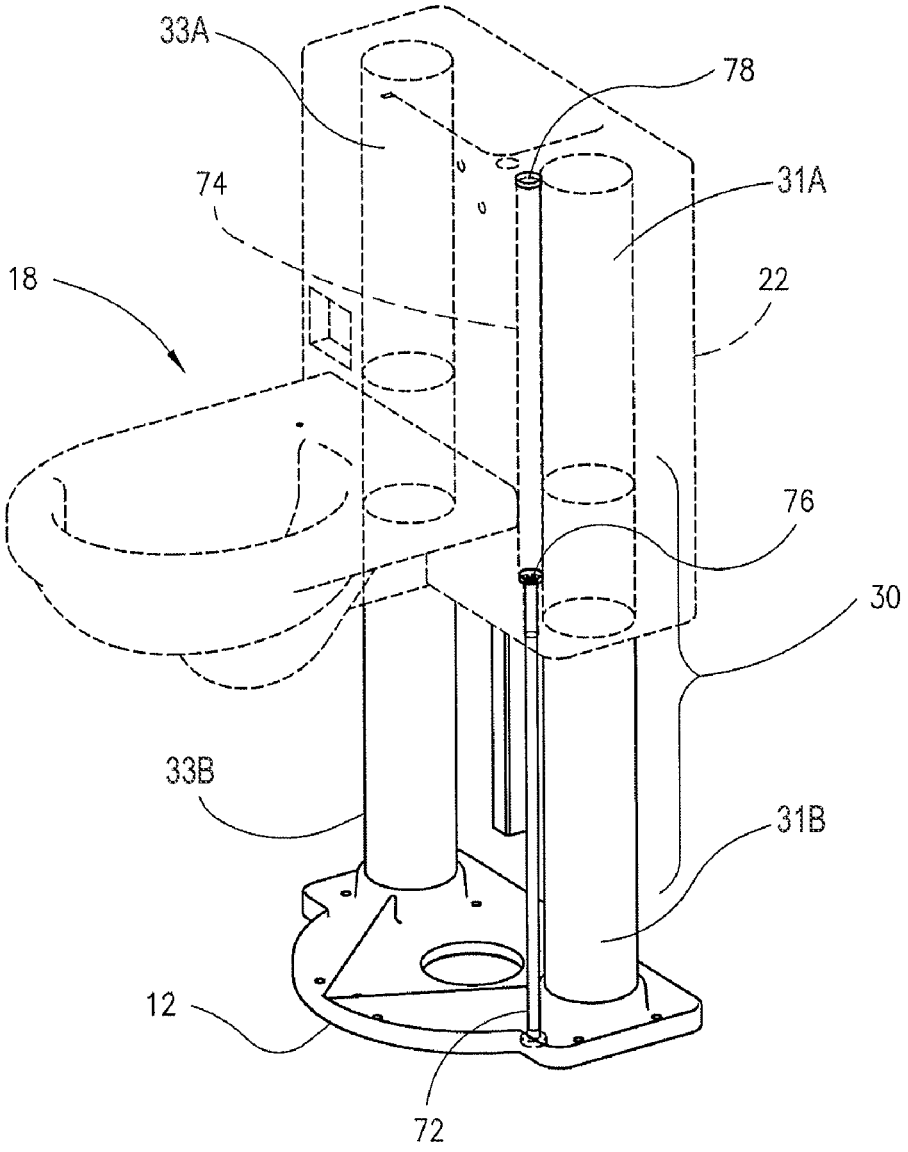
FIG. 4 is a perspective view of the adjustable toilet of FIG. 1 showing additional details of the height adjustment system, according to one implementation of the present disclosure.

FIGS. 3-4 are perspective views of the adjustable toilet 10 showing an embodiment of a height adjustment system. The height adjustment system includes one or more lifting cylinders 30, which may be pressurized by a fluid as described below to raise the toilet housing 18. Gravitational force may be used to exhaust the liquid from the lifting cylinders 30. Two pairs of lifting cylinders 30 each contain cylinders having a diameter of about 10 cm (4 inches). The pairs of lifting cylinders 30 may be used for lifting the toilet bowl 20 through a total stroke of about 38 cm (15 inches). Other types of lifting devices, such as pneumatic cylinders or mechanical actuators, may be substituted for the lifting cylinders 30 if desired.

FIG. 3 shows how the bottom position of the toilet housing 18 can be adjusted. An internally-threaded, square-section bottom stop bar 66 and a stop screw 68 are mounted in the tank housing 22. The bottom stop bar 66 can slide in a vertical direction in the tank housing 22. The rotatable stop screw 68 of the bottom stop bar 66 is moved up or down. The bottom stop bar 66 will contact the toilet base 12 in the desired portion and stop any further lowering of the toilet housing 18. FIGS. 3 and 4 further show the first and second fluid lifting cylinders 30, wherein the first fluid lifting cylinder has a first rigid cylinder portion 31A and a second rigid cylinder portion 31B and the second fluid lifting cylinder has a first rigid cylinder portion 33A and a second rigid cylinder portion 33B.

FIG. 4 illustrates how the upward stroke of the toilet housing 18 may be stopped. A top stop bar 72 is firmly held in the toilet base 12 and extends into a hole 74 in the tank housing 22. The top stop bar 72 has an enlarged top end 76 (larger than a reduced-diameter bottom flange of the hole 74) which interferes with further upwards motion once it contacts the bottom flange. The length of the top stop bar 72 may be adjustable. A plug 78 covers the hole 74 on top.

Figure 5:
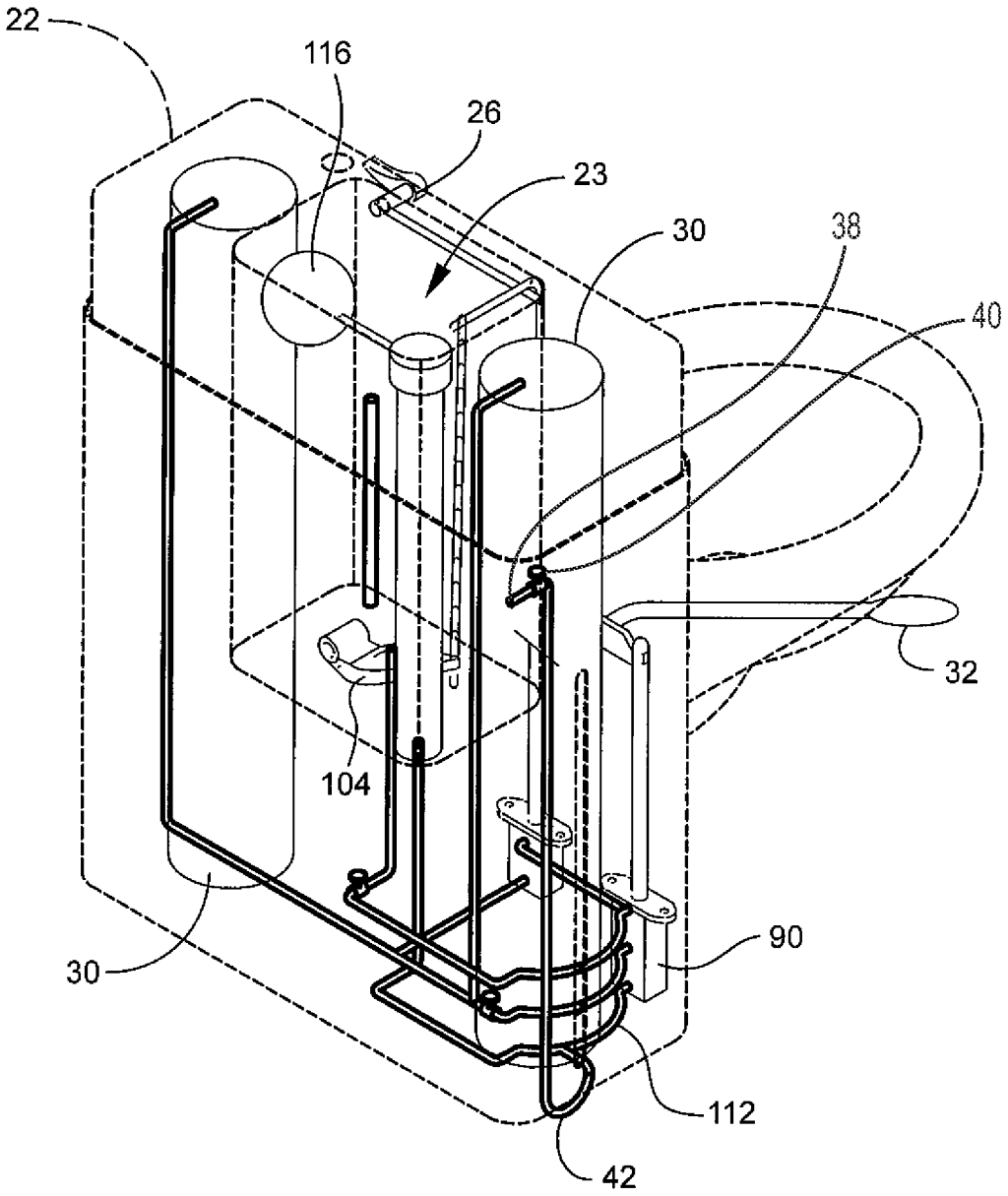
FIG. 5 is a perspective rear-side view showing fluid piping of the adjustable toilet of FIG. 1, according to one implementation of the present disclosure.
Figure 6:
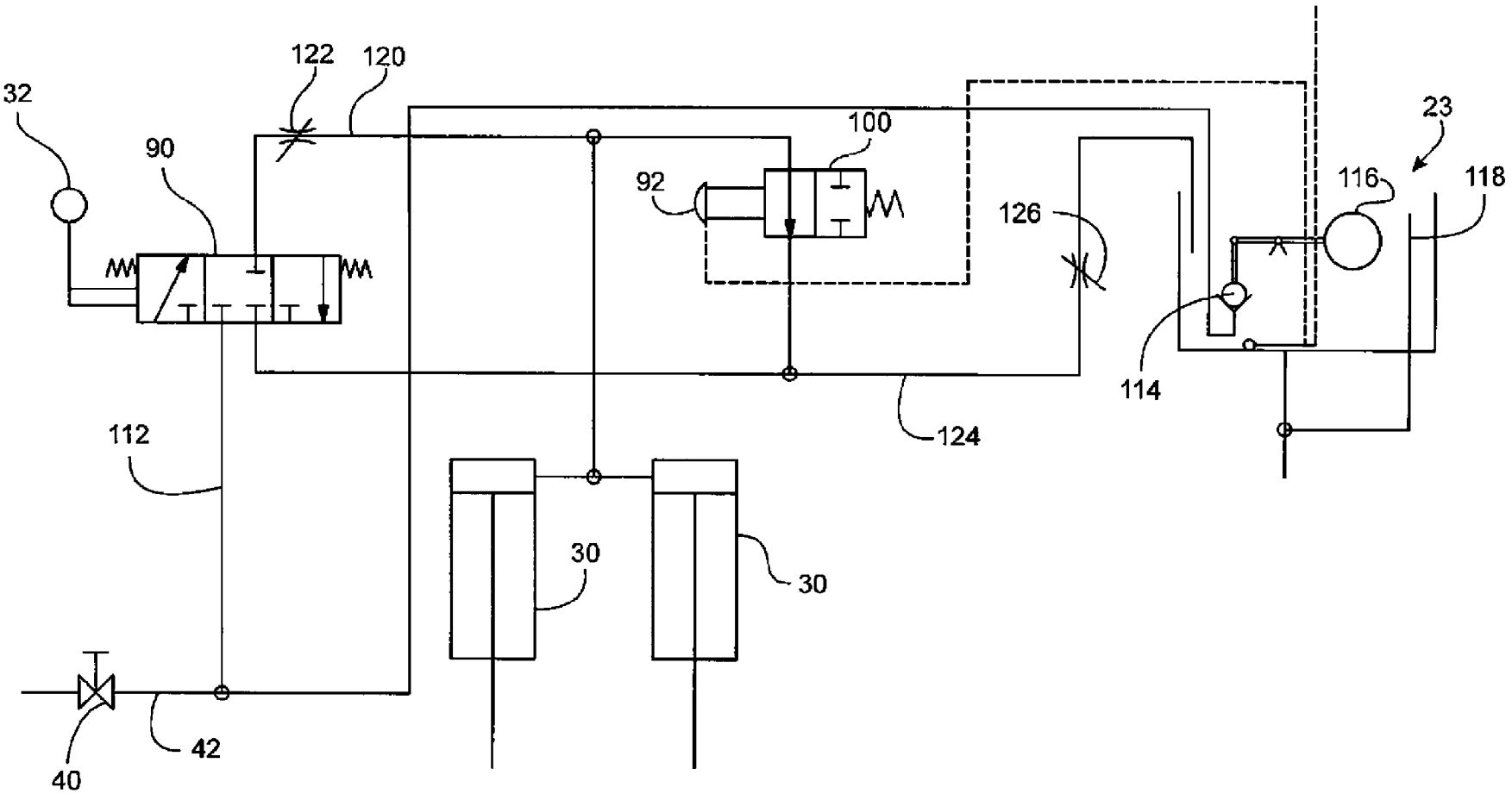
FIG. 6 is a diagram showing the fluidic connections of the adjustable toilet of FIG. 1, according to one implementation.

FIG. 5 is a perspective back side view showing an embodiment of fluid piping that may be used with the adjustable toilet 10. FIG. 6 is a diagram showing the fluidic connections of the adjustable toilet 10. FIGS. 5 and 6 illustrate the structure of the raising and lowering system of the adjustable toilet 10. Fluid (typically domestic water supply) enters the system from wall outlet 38 through the shut-off valve 40. It is piped through the flexible connector hose 42 and valve supply pipe 112 to the lift valve 90. It also flows through the valve supply pipe 112 to a standard filler valve 114, which is operated by a float 116 in the water tank 23. An overflow tube 118 of a standard type has one end disposed in the water tank 23. The water tank 23 may be an integral part of the tank housing 22.

A cylinder supply line 120 extends between the lift valve 90 and the lifting cylinders 30, and may include a raising throttle 122 therein (e.g. a fixed or variable orifice) for controlling the speed of the raising motion. As shown, the lifting cylinders 30 may also be integrally-formed with the tank housing 22. A recycling line 124 connects to lift valve 90 to the water tank 23. A lowering throttle 126 in the recycling line 124, similar to the raising throttle 122, enables control of the descending speed of the toilet bowl 20. The drain valve 100 is connected to the lift valve 90 on one side and to the cylinder supply line 120 on the other side to enable automatic resetting of the toilet bowl 20 when the lid 36 is closed.

Manual lifting and lowering of the toilet housing 18 operates as follows. To raise the toilet housing 18, the height adjustment lever 32 is raised, causing pressurized water to flow into the lifting cylinders 30. To lower the toilet housing 18, the height adjustment lever 32 is lowered, allowing water to be forced out of the lifting cylinders 30 and through the recycling line 124 into the water tank 23. To the extent that raising and lowering the toilet housing 18 without flushing causes the water tank 23 to approach an overfilled condition, the excess water drains through the overflow tube 118.

A height adjustment lever 32 is also incorporated into the tank housing 22 and serves as the control for raising or lowering the toilet housing 18. A seat 34 and lid 36 are mounted on top of the toilet bowl 20. A water supply is fed to the adjustable toilet 10 through a wall outlet 38, for example using a shut-off valve 40 feeding a flexible connector hose 42.

Figure 7:
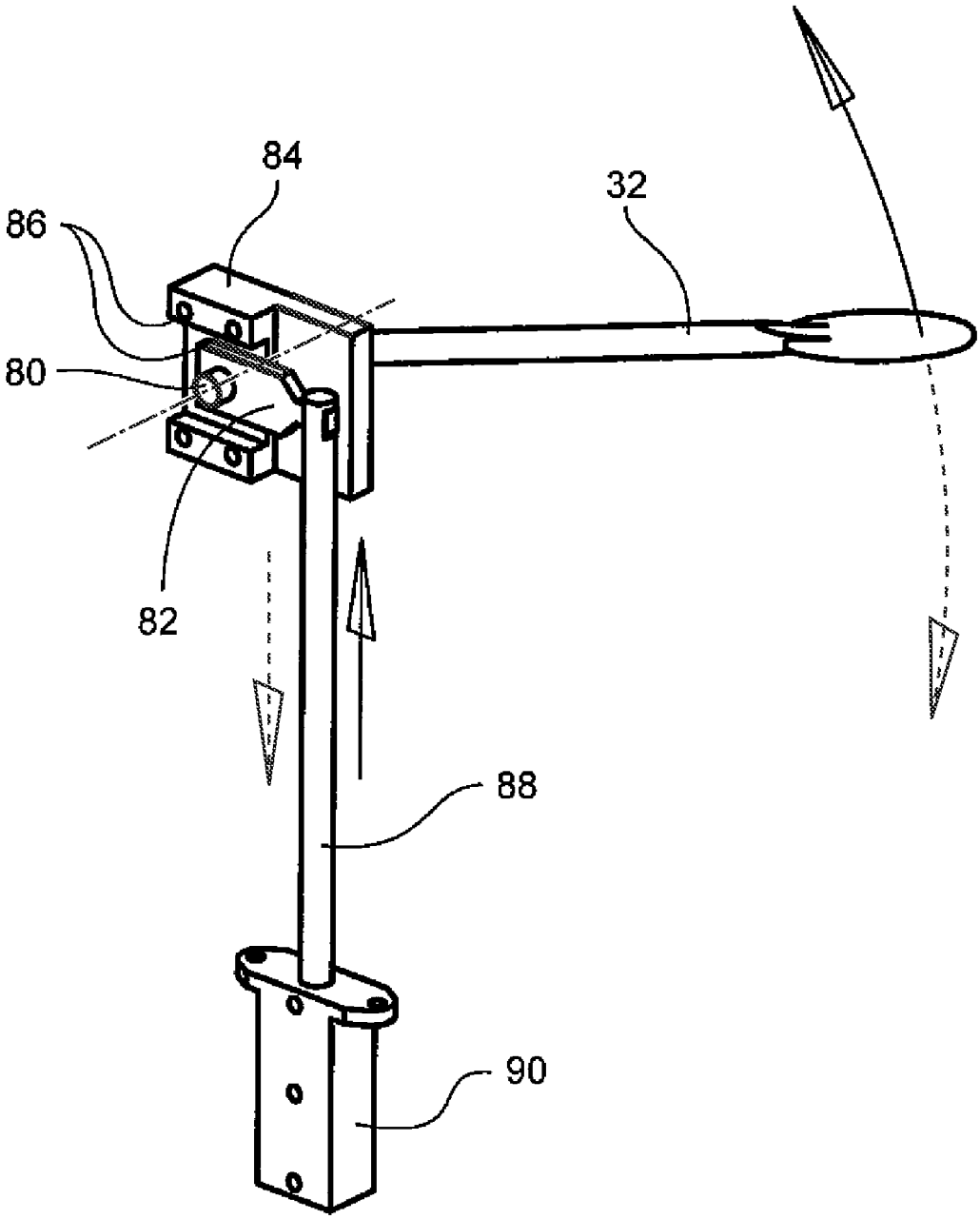
FIG. 7 is a perspective view of a height adjustment controller of the adjustable toilet of FIG. 1, according to one implementation.

FIG. 7 is a perspective view illustrating an embodiment of a height adjustment controller that may be used with the adjustable toilet of FIG. 1 or other toilet having an adjustable height. The height adjustment controller includes linkage for raising and lowering the toilet bowl 20. It includes the height adjustment lever 32 with pivot shaft 80 and extension lever 82 connected thereto. A pivot plate 84 is mounted on the tank housing 22 using mounting holes 86 and allows the height adjustment lever 32 to pivot. An actuating rod 88 of a lift valve 90 is connected to the extension lever 82. Moving the height adjustment lever 32 up or down moves the actuating rod 88 out of or into the lift valve 90. In this example, the lift valve 90 may be a 3-way valve of a type that is manually operated. The lift valve 90 may have three positions and may be spring-centered.

Figure 8:
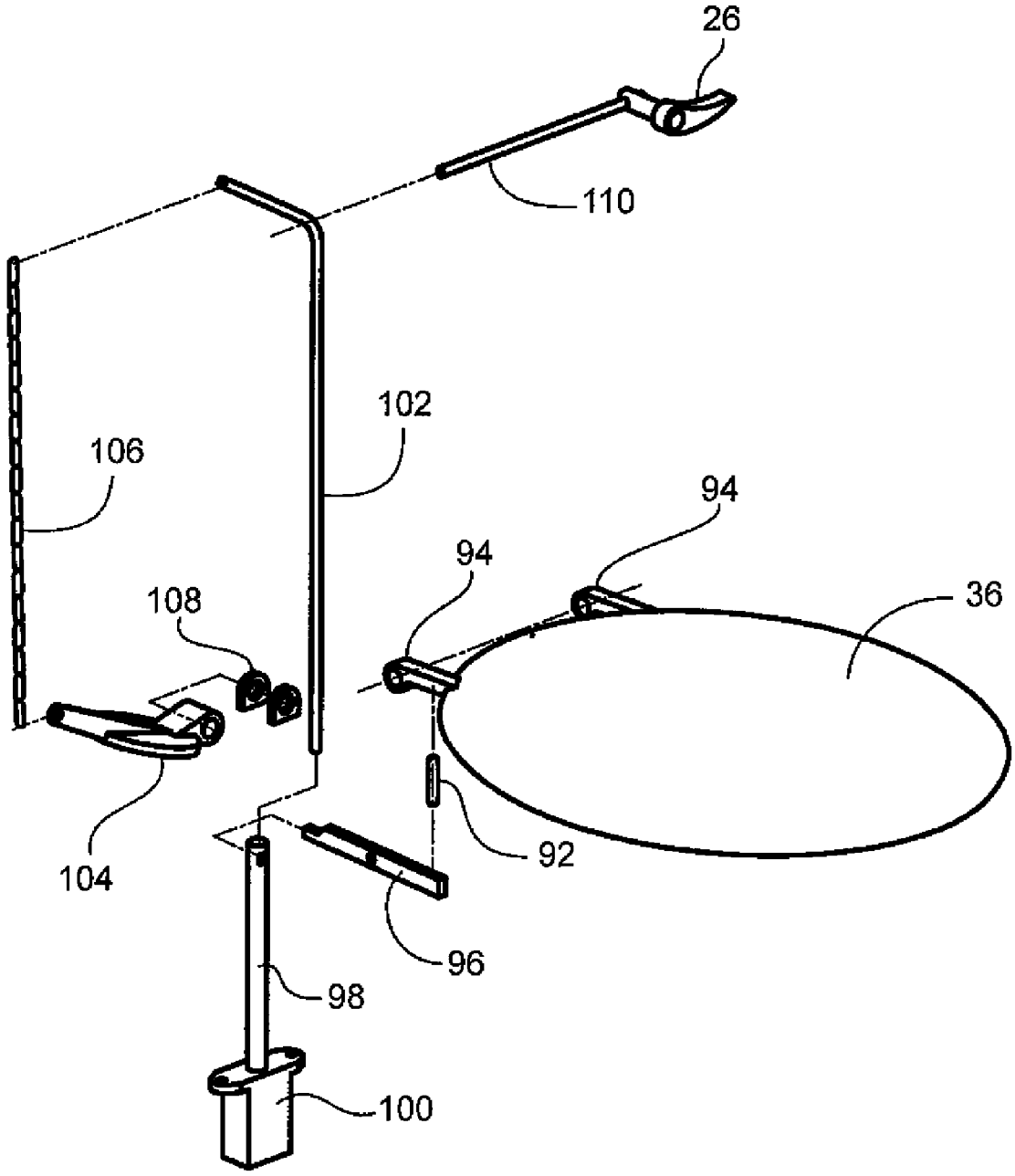
FIG. 8 is an exploded view of an automatic flushing and height adjustment system of the adjustable toilet of FIG. 1, according to one implementation.
Figure 9:
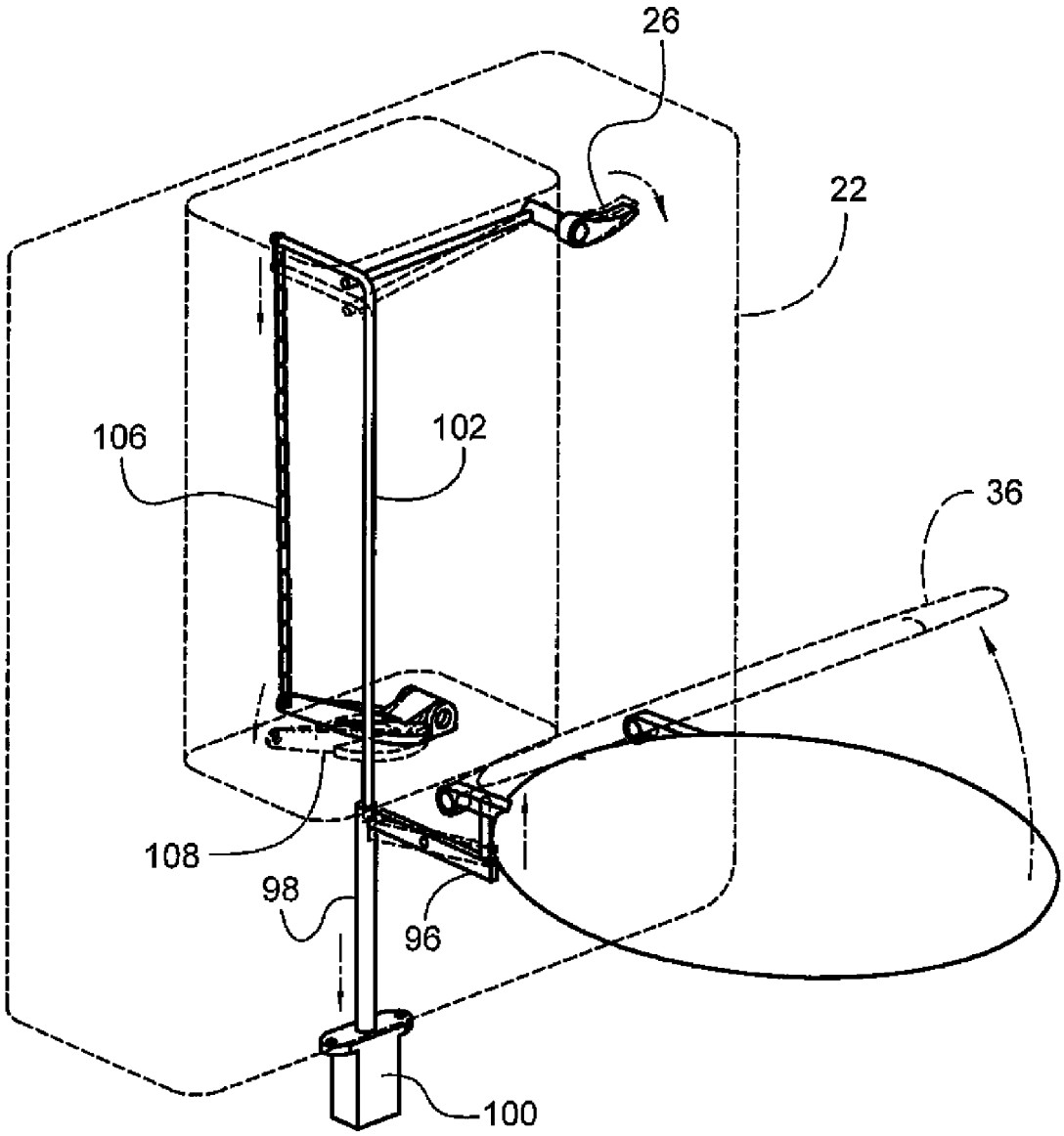
FIG. 9 is a perspective view of the automatic flushing and height adjustment system of FIG. 8.

FIG. 8 shows an exploded view of an embodiment of an automatic flushing and height adjustment system of the adjustable toilet of FIG. 1. Also, FIG. 9 is a perspective view of the automatic flushing and height adjustment system of FIG. 8. The automatic flushing and height adjustment system shown in FIGS. 8 and 9 is capable of automatically resetting the toilet to a predetermined height while simultaneously performing an automatic flushing action. An automatic resetting pin 92 is positioned under one of the mounts 94 of the lid 36, and is connected to the front end of a pivot link 96, the rear end of which is connected to the actuating rod 98 of a drain valve 100. In this example, the drain valve 100 is a normally-closed, manually-operated and spring-biased 2-way valve. The rear end of the pivot link 96 is connected to an upright flushing rod 102 which in turn is connected to a conventional flapper valve 104 by a flapper chain 106. The flapper valve 104 is pivotally held by a flapper pivot 108. The flush handle 26 is pivotally mounted to the tank housing 22 and connected to the flushing rod 102 by a lever extension 110. Thus, the toilet may be flushed automatically by closing the lid 36 or by pressing the flush handle 26.

If desired, the adjustable toilet 10 may be flushed by pushing the flush handle 26 down in a clockwise motion. This raises the lever extension 110 which is positioned under the flushing rod 102. This motion will cause the flapper chain 106 to open the flapper valve 104 in order to flush the toilet, in a conventional manner.

The automatic resetting of the toilet height adjustment and simultaneous automatic flushing features operates as follows. Lowering the lid 36 will depress the automatic resetting pin 92, which in turn rotates pivot link 96 clockwise. This will raise the actuating rod 98 of the drain valve 100, opening the drain valve 100 to release the liquid out of the lifting cylinders 30 through the recycling line 124, and allowing the tank housing 22 to lower to its bottom position.

Figures 10A, 10B, 10C:
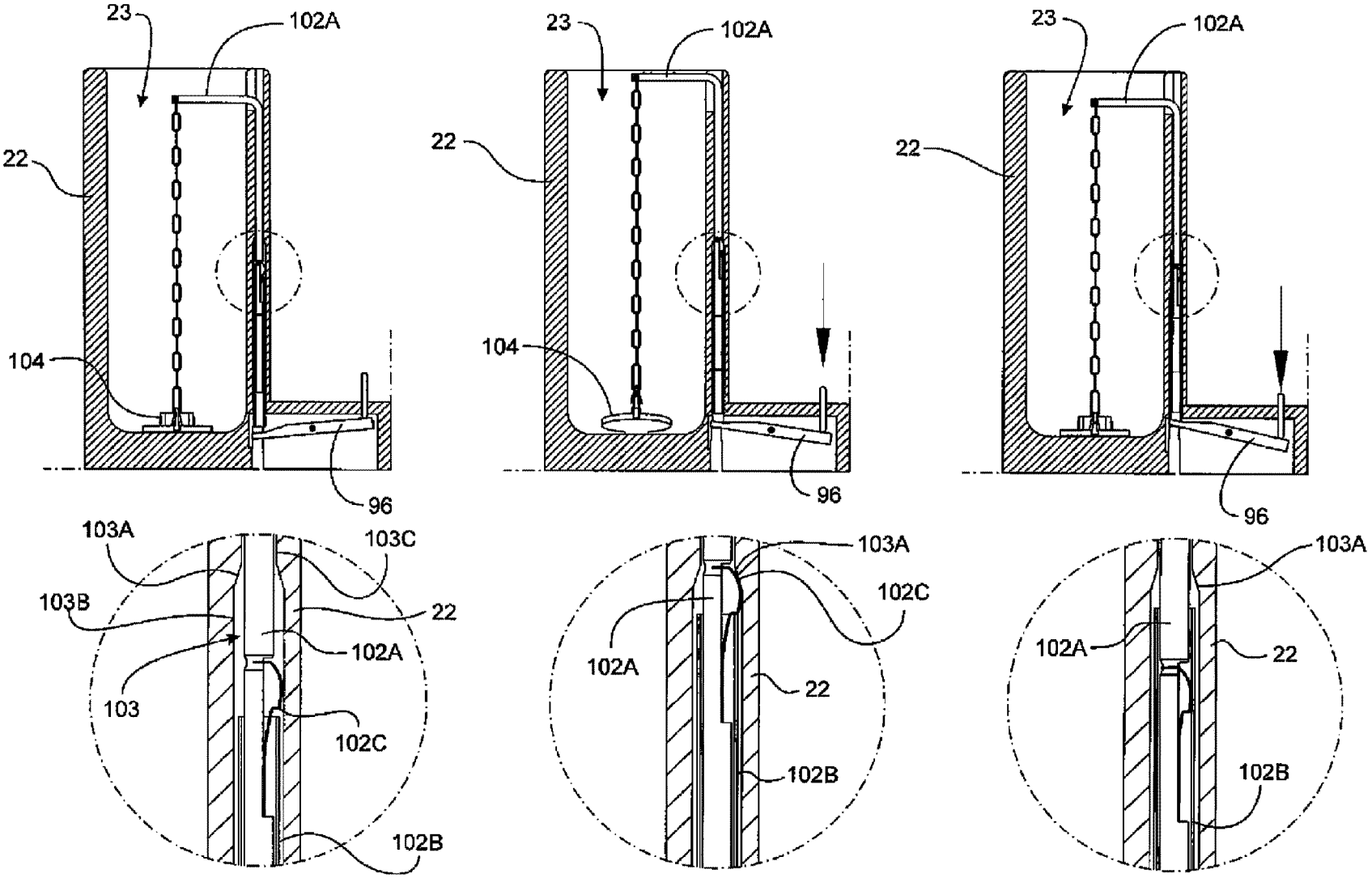
FIGS. 10A through 10C are cross-sectional views of a flushing mechanism shown in sequential modes of operation, according to one implementation.

FIGS. 10A-10C show cross-sectional views of an embodiment of a flushing mechanism. The flushing mechanism of FIGS. 10A-10C is shown in sequence throughout a flushing cycle. For example, FIG. 10A shows an initial state in which water is allowed to collect within the water tank 23 as the flapper valve 104 remains closed. FIG. 10B shows an initial flush action where the resetting pin 92 (see FIGS. 7-8) is compressed by the closing of the lid 36 or the flush handle 26 is pressed. FIG. 10C shows a releasing action that allows the flapper valve 104 to close when the lid 36 remains closed.

Simultaneously, the pivot link 96 lifts the flushing rod 102 and flapper chain 106, opening the flapper valve 104 to initiate a flush cycle. When the flushing rod 102 is initially raised (FIG. 10A), the spring latch 102C maintains the upper and lower portions 102A and 102B extended at their full length. As the flushing rod 102 is raised further, the spring latch 102C is depressed by contact with the tapered section 103A of the channel 103, shown in FIG. 10B, allowing the upper portion 102A to collapse into the lower portion 102B, as shown in FIG. 10C. This allows the flapper valve 104 to close normally. When the pivot link 96 is lowered again, the flushing rod 102 extends to its full length and the spring latch 102C resets. Thus, the act of closing the lid 36 both empties the toilet 10 and resets its height for the next user. The space vacated in the water tank 23 as the flush cycle occurs provides room to receive the water drained from the lifting cylinders 30. The automatic lowering feature and/or the automatic flushing feature may be implemented together as described herein, separately, or not at all.

The amount of water to be used for a full lift of about 38 cm (15 inches) is about 6 liters (1.6 gallons). This amount of fluid is released into the water tank 23 and will be used for the next flushing. In this manner, the water for the lifting action is not wasted (i.e. drained through the overflow tube 118) but is preserved, and is the same amount as is legally required at this time to be the maximum to be used for one flushing. It is also noted that the use of two lifting cylinders 30 of approximately 10 cm (4 in.) diameter results in a total lifting force of about 227 kg (500 lbs.) at a nominal water pressure of about (20 psi). In the unlikely case that the line water pressure does not suffice, a booster pump of known type can be inserted between the water line and the system of the adjustable toilet.

The flushing rod 102 includes means for allowing the flapper valve 104 to return to a closed position after the flush cycle is completed. In the example illustrated in FIGS. 10A-10C, the flushing rod 102 comprises an upper portion 102A received inside a tubular lower portion 102B. The upper portion 102A carries a laterally-moveable spring latch 102C at its lower end. The flushing rod 102 is carried in a vertical hole or channel 103 in the tank housing 22 which includes a tapered section 103A connecting a lower section 103B and a narrower upper section 103C.

The flushing mechanism shown in FIGS. 10A-10C may include the flushing rod 102, the channel 103, and a flush tube (i.e., the tubular lower portion 102B) that may be lifted by the pivoting action of the pivot link 96. The flushing rod 102 may be attached to a flapper (i.e., flapper valve 104) configured to seal an opening in a bottom portion of the tank housing 22. The flushing rod 102 may include a reduced-diameter section that engages with the spring latch 102C. The spring latch 102C has a shoulder and a forked portion. The flush tube 102 is configured to move in an upward direction during a flushing process (FIG. 10B) causing the flush rod 102 to lift the flapper 104 from the opening to allow water to escape from the tank housing 22.

When moved in the upward direction, the top end of the flush tube 102B contacts a bottom surface of the shoulder of the spring latch 102C to lift the spring latch 102C until it intersects the tapered section 103A. With continued upward movement, the forked portion of the spring latch 102C is forced toward a central axis of the flushing rod 102. When the forked portion moves enough toward the central axis of the flushing rod 102, the shoulder of the spring latch 102C moves within an interior diameter of the flush tube and then drops down into the interior of the flush tube 102B as shown in FIG. 10C. This dropping movement causes the flushing rod 102 to drop within the tank housing 22 to allow the flapper 104 to also drop down into the opening of the tank housing 22 to seal the opening.

Figure 11:
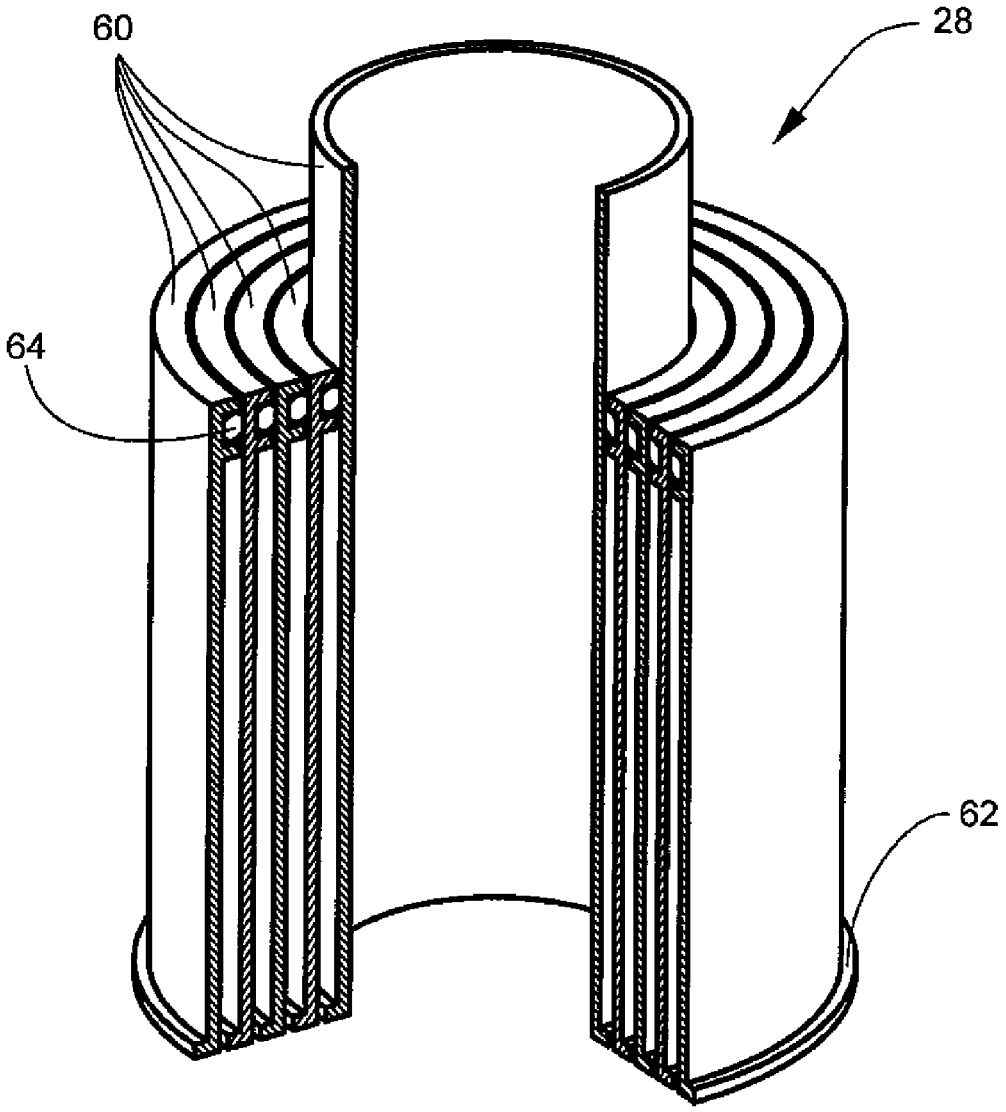
FIG. 11 is a cutaway, perspective view of a collapsible drainage pipe of the adjustable toilet of FIG. 1 shown in its fully collapsed state, according to one implementation.
Figure 12:
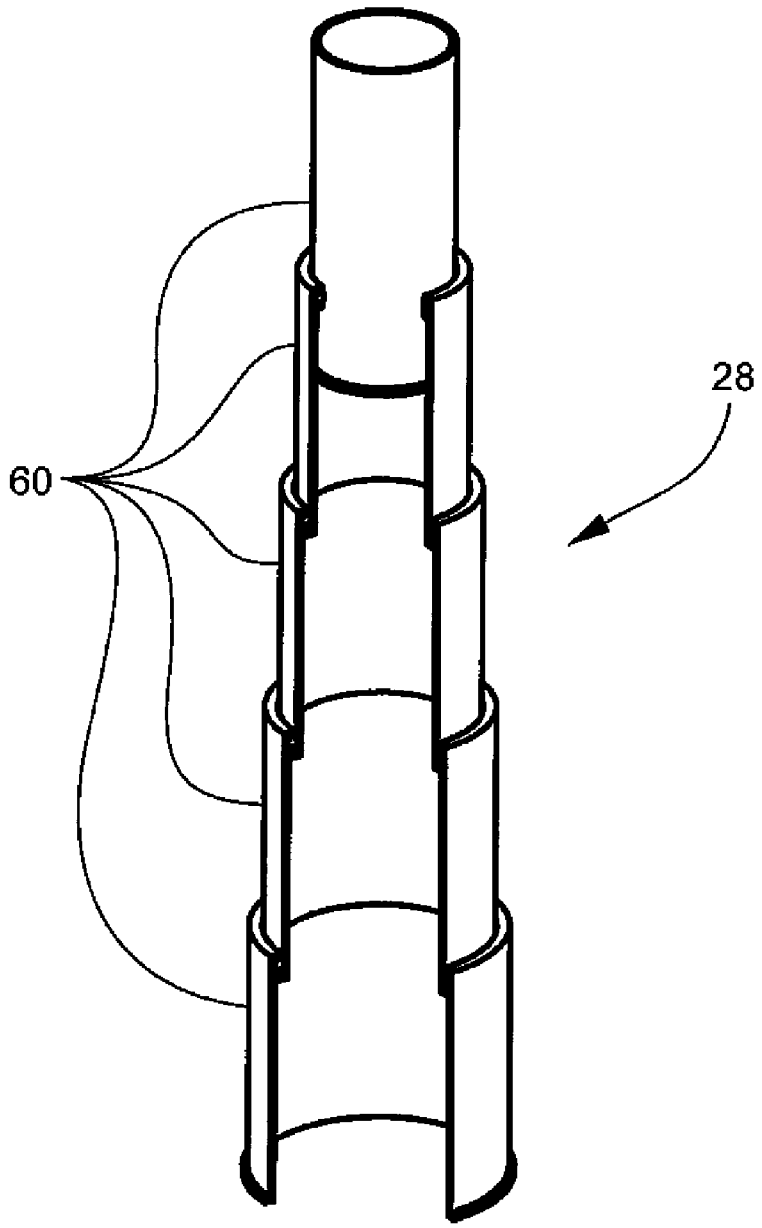
FIG. 12 is a cutaway, perspective view of the collapsible drainage pipe of FIG. 11 in its extended state.

FIG. 11 shows a cutaway, perspective view of an embodiment of the collapsible drainage pipe 28 of the adjustable toilet 10. FIG. 12 shows another cutaway, perspective view of the collapsible drainage pipe 28. FIG. 11 shows the collapsible drainage pipe 28 in its fully collapsed state and FIG. 12 shows it in its extended state. Furthermore, FIG. 13 shows a cross-sectional view of the collapsible drainage pipe 28' mounted to a toilet and to a drainage system, the collapsible drainage pipe 28' shown in its collapsed state.

The drainage pipe assembly 28, 28' is made up from several closely-fitted concentric pipe segments 60, with their diameter decreasing from the bottom of the assembly 28, 28' to its top. Each pipe segment 60 has an outwardly-extending flange 62 at its lower end and a resilient ring 64 at its upper end to provide a seal against leakage of waste, odor, and liquid. In FIG. 11, the drainage pipe assembly 28 is collapsed as is the case with the toilet bowl 20 in its lowest position. In FIG. 12 the drainage pipe assembly 28 is extended as is the case with the toilet bowl 20 in its highest position. The ever increasing diameter from the top segment 60 to the bottom segment 60 prevents the drainage pipe assembly 28, 28' from presenting a "shelf" which could collect waste. The lowering and raising of the toilet bowl 20 will have a scrubbing action on the side walls of the drainage pipe assembly 28, 28' and drop the scrubbed off particles effectively down a drainage hole in the floor.

Figure 13:
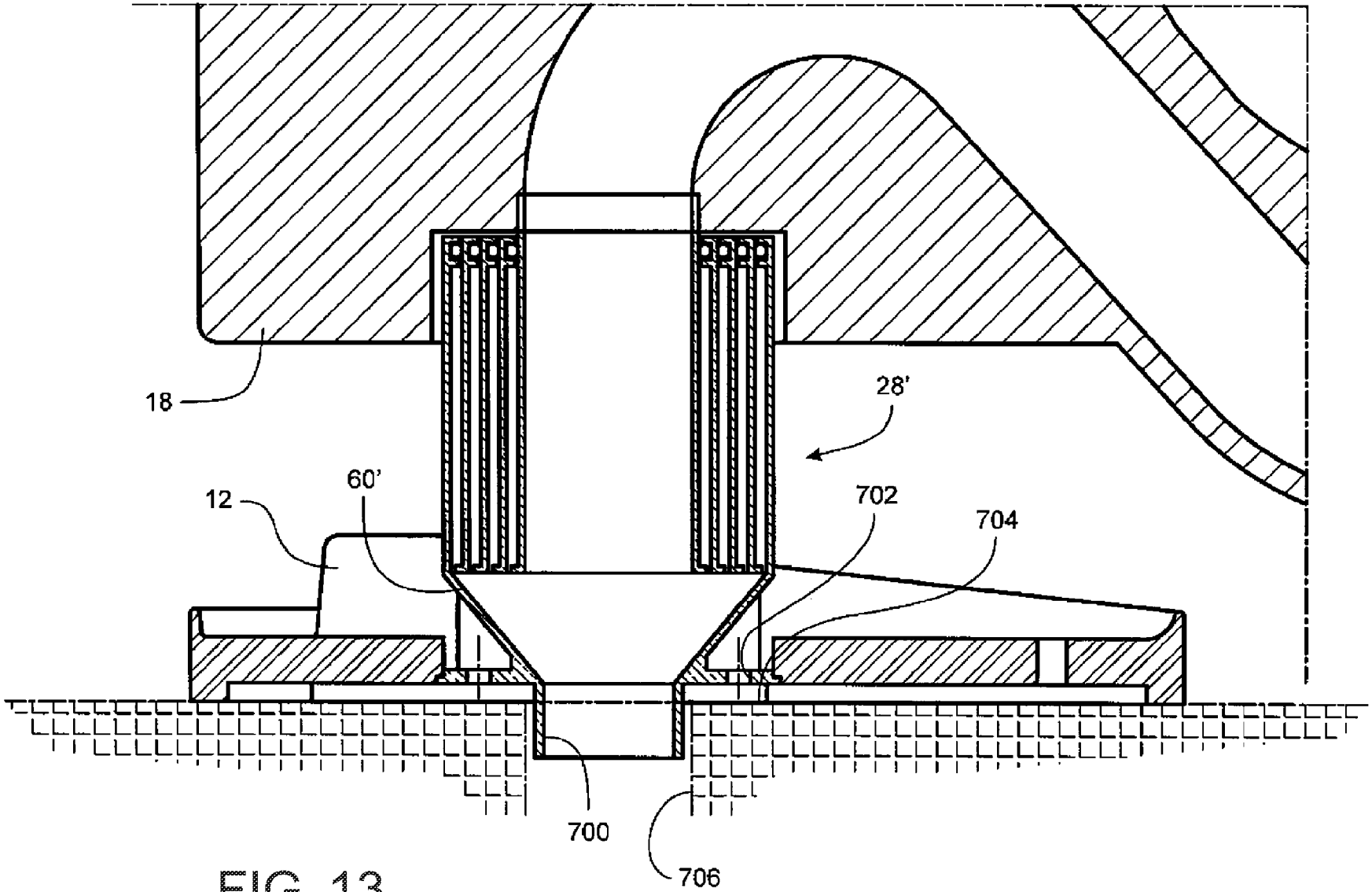
FIG. 13 is a cross-sectional view of the collapsible drainage pipe of FIG. 11 shown mounted to a toilet and drainage system, according to one implementation.

As shown in FIG. 13, the toilet base 12 may be provided with a pipe stub or "horn" 700 and mounting bolt holes 702 which allow it to be mounted to a standard plumbing toilet flange 704 and drain pipe 706. To accommodate this mounting, an alternative drain pipe assembly 28' may be used which has a tapered bottom pipe segment 60' to make a smooth transition to the diameter of the horn 700.

FIGS. 14-18 show perspective views of various embodiments of adjustable toilet lifts. These lifts may be used with the toilet 10 described above or with an existing toilet.

Figure 14:
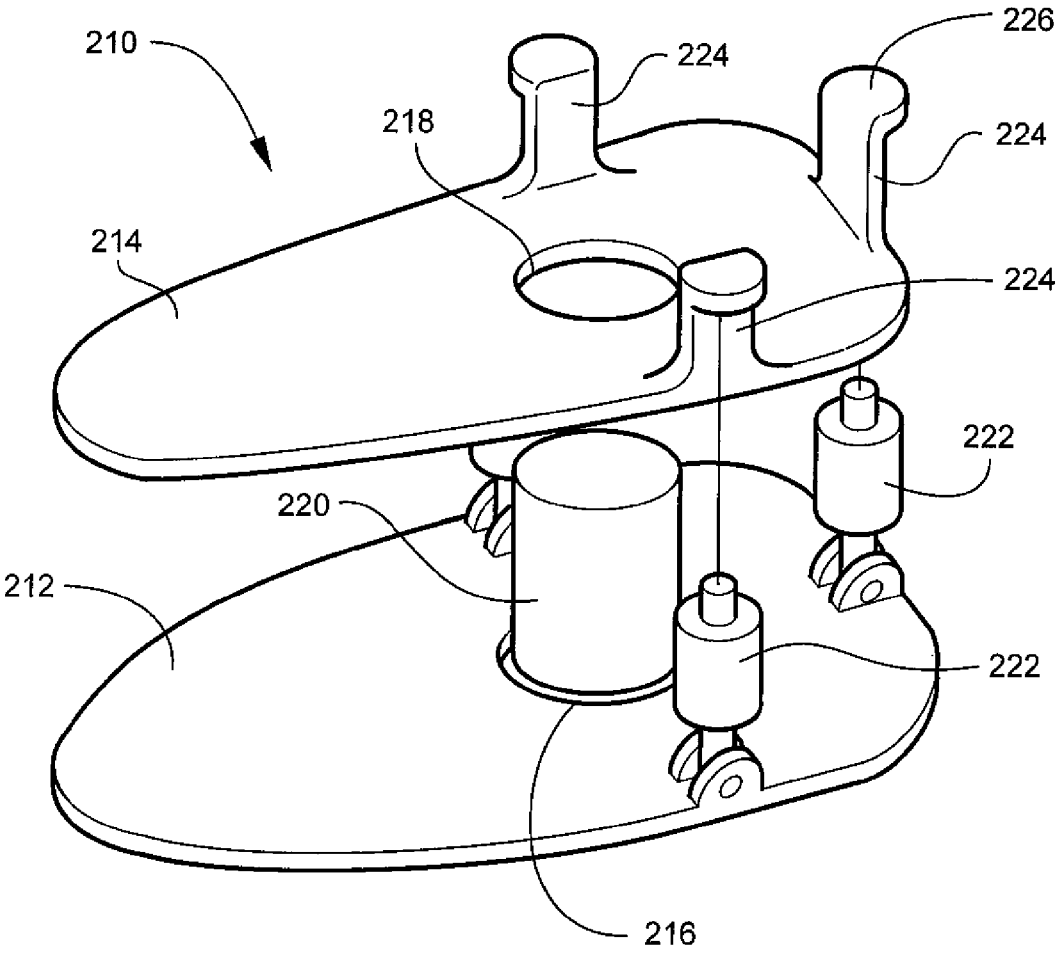
FIG. 14 is a perspective view of an adjustable toilet lift, according to a first implementation.

A first exemplary adjustable toilet lift 210 is illustrated in FIG. 14. The toilet lift 210 includes a base plate 212 and a top plate 214, and one or more actuators 222 for moving the top plate 214 relative to the base plate 212, which are pivotally connected hydraulic jacks in the illustrated example. The top plate 214, which carries a standard toilet (not shown), includes three flange members 224 extending upward and having horizontal members 226 at the upper ends thereof, which engage the actuators 222.

Two aligned bores 216, 218 are positioned within the base plate 212 and top plate 214, respectively, to allow discharge from the toilet to pass through the lift 210 by way of a drain extension 220. The bore 216 of the base plate 212 is connected to the drain opening in the floor, and the bore 218 of the top plate 214 is connected to the drain outlet of the toilet. An external power source (not shown) such as a hydraulic pump is employed to selectively raise and lower the actuators 222.

Figure 15:
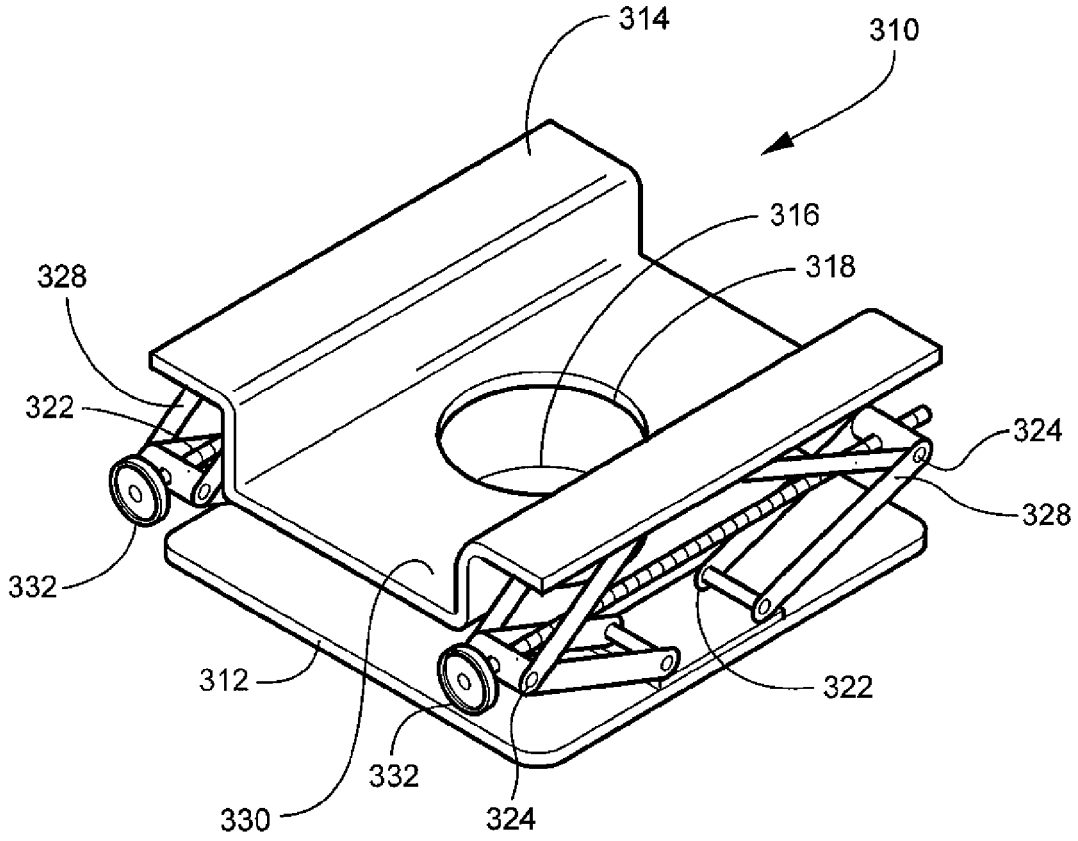
FIG. 15 is a perspective view of an adjustable toilet lift, according to a second implementation.

FIG. 15 shows a second adjustable toilet lift 310 in which the actuator comprises one or more scissor frame jacks 328 positioned between a base plate 312 and a top plate 314. The jacks 328 each include a threaded screw 322 extending laterally therethrough with an optional turning knob 332 positioned on one end. As the screw 322 is turned in one direction, frame hinges 324 move along the threads of the screw 322 toward each other, causing the jacks 328 to extend upward. When the screw 322 is turned in the opposite direction, the frame hinges 324 move away from each other, causing the jacks 328 to collapse downward. Two aligned bores 316, 318 are positioned within the base plate 312 and top plate 314, respectively, which allow discharge from the toilet to pass through the lift 310 by way of a drain extension (not shown). Preferably, the top plate 314 includes a lowered channel 330 for receiving a toilet and providing added stability. An external power source (not shown) can be employed to rotate the screw 322. In the alternative, the knob 332 can be turned manually.

Figure 16:
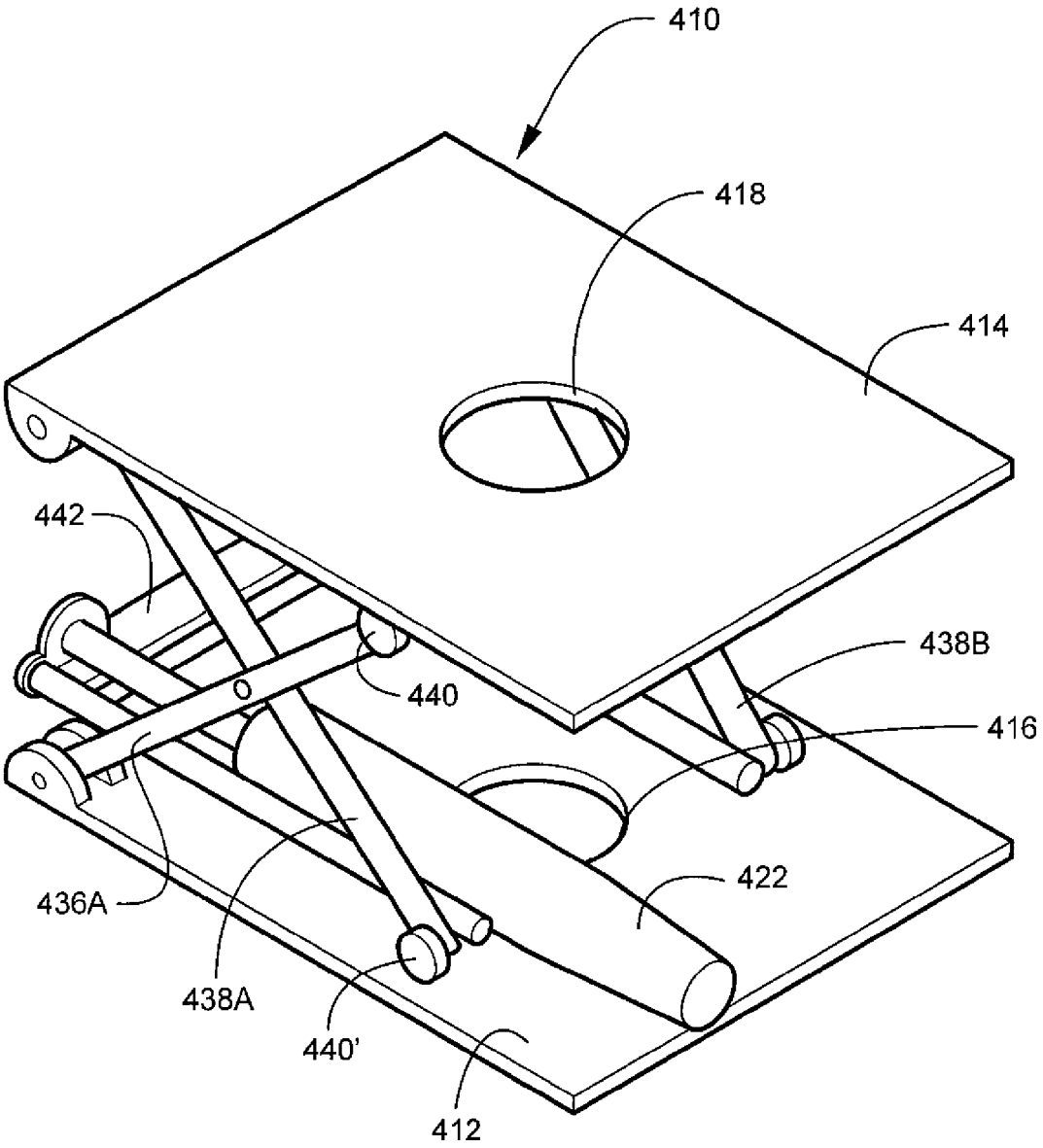
FIG. 16 is a perspective view of an adjustable toilet lift, according to a third implementation.

FIG. 16 shows a third adjustable toilet lift 410 in which an X-frame, located between a base plate 412 and a top plate 414, comprises a first pair of rods 436A, 438A and a second pair of rods 436B, 438B. The pairs are identical and only 436A and 438A are described in detail. The rods 436A, 438A are arranged in a crisscross fashion and pivotally connected by a pin 439. One end of rod 436A is pivotally connected to the base plate 412, while the other end, which carries a rolling wheel 440, contacts the underside of the top plate 414. One end of rod 438A is pivotally connected to the underside of the top plate 414, while the other end, which carries a rolling wheel 440', contacts the base plate 412. An adjusting frame 442 is connected to rod 438A in close proximity to the rolling wheel 440'. The adjusting frame 442 comprises a rod arrangement that is connected to and driven by an actuator, such as the illustrated gas spring 422.

Movement of the gas spring 422 moves the adjusting frame 442, which in turn drives the rolling wheel 440 in a horizontal direction to move the top plate 414 relative to the base plate 412. Two centrally located bores 416, 418 are positioned within the base plate 412 and top plate 414, respectively, which allow discharge from the toilet to pass through the lift 410 by way of a drain extension (not shown).

Figure 17:
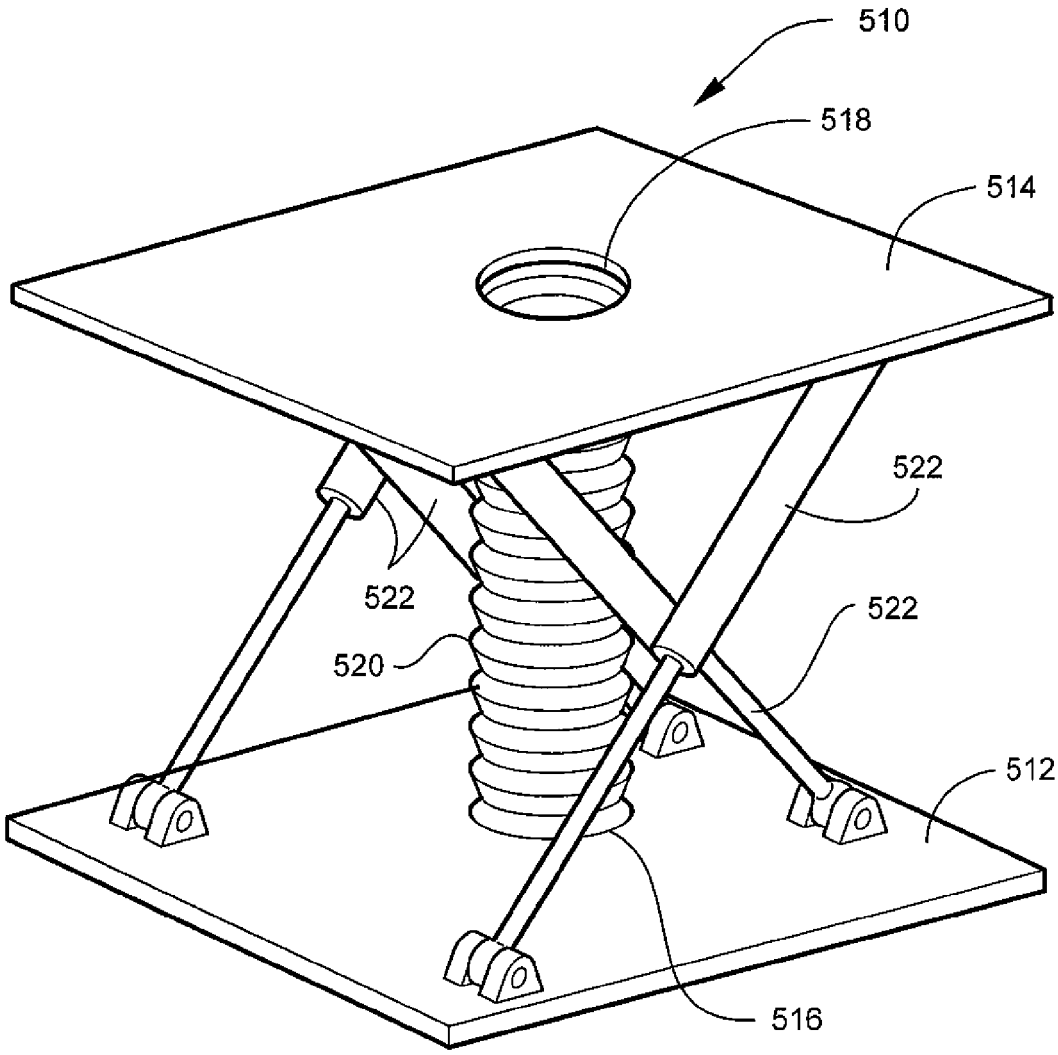
FIG. 17 is a perspective view of an adjustable toilet lift, according to a fourth implementation.

FIG. 17 shows a fourth adjustable toilet lift 510 that employs a plurality of actuators 522 which are pivotally connected to both the base plate 512 and top plate 514. The actuators 522 are arranged in a crisscross arrangement. Extension or retraction of the actuators 522 raises or lowers the top plate 514 respectively, while the crisscross configuration provides stability to the top plate 514. The actuators 522 may be any device capable of raising the top plate 514 under a load, such as screw jacks, pneumatic jacks, or spring lifts. In the illustrated example, the actuators 522 are gas springs. A flexible, extendible drain extension 520 extends between bores 516, 518 located in the base plate 512 and top plate 514, respectively.

Figure 18:
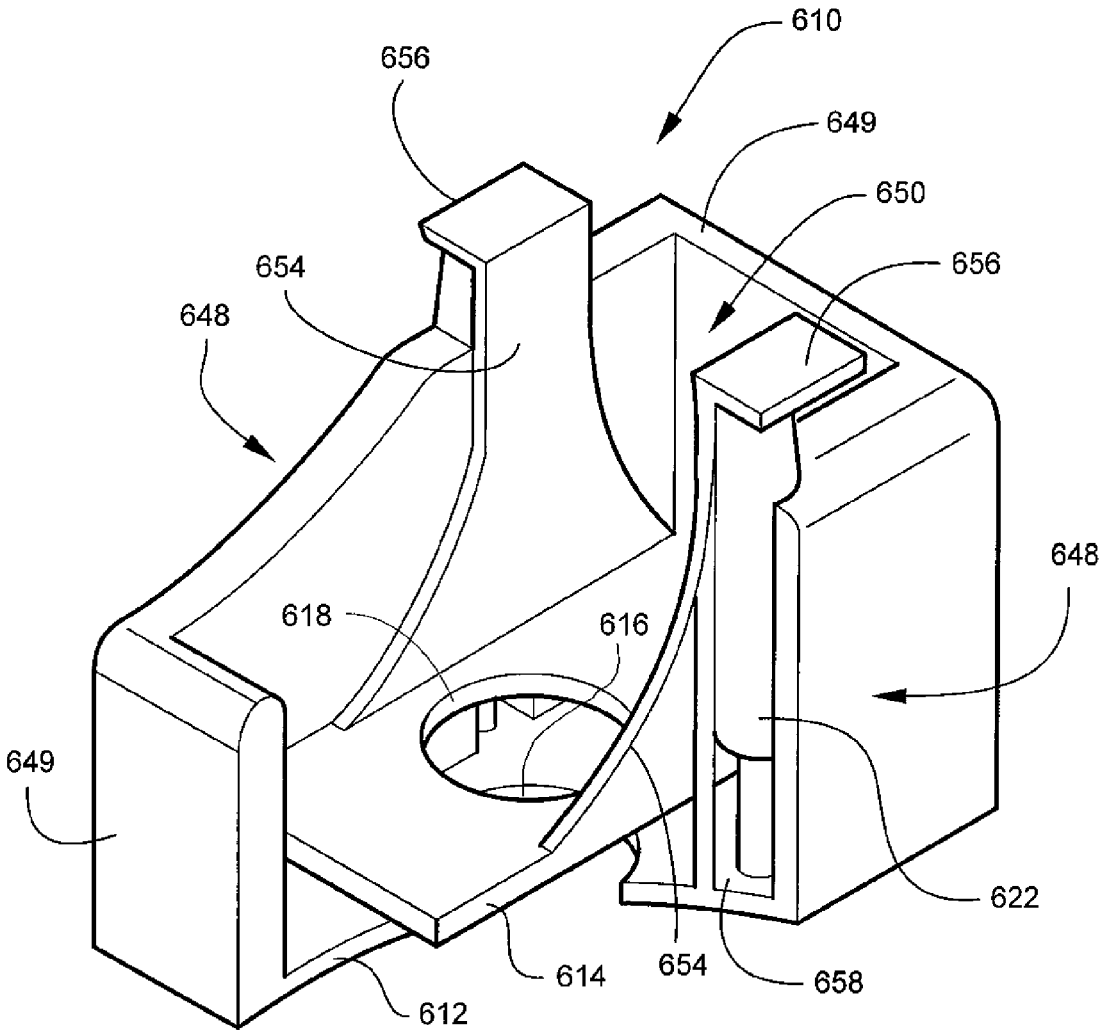
FIG. 18 is a cutaway perspective view of an adjustable toilet lift, according to a fifth implementation.

FIG. 18 shows a fifth adjustable toilet lift 610 comprising a base plate 612 having spaced-apart side portions 648 and spaced-apart end walls 649, which extend upwardly to collectively form a cavity 650 therein. An open-ended chamber 658 is located within each of the side portions 648 and houses an actuator for adjusting a top plate 614 relative to the bottom plate 612, which is a gas spring 622 in the illustrated example. A top plate 614 defines two upwardly extending side members 654, including outwardly extending flange members 656 at the upper ends thereof. The side members 654 are connected to the distal ends of the gas springs 622 which protrude through the open end of the chambers 658. Two centrally located bores 616, 618 are positioned within the base plate 612 and top plate 614, respectively, to allow discharge from a toilet to pass through the lift 610 by way of a drain extension (not shown). The cavity 650 of this embodiment provides the added benefit of increased support to the base of the toilet, which prevents bending moments. In addition, the side portions 648 provide a decorative touch that is more aesthetically pleasing to a consumer and protect the gas springs 622.

The lifts as described herein with respect to FIGS. 14-18 allow an individual to preset the required height of the toilet before use. After the user is seated upon the seat of the toilet, the height can be further adjusted to accommodate the requirements and desires of the user. After use, the height can be adjusted again to allow users to safely remove themselves from the seat. The adjustment of the height can be accomplished by way of an external power source before, during, and after use.

The lifts illustrated in FIGS. 14-18 can be integral to a toilet or separately installed on an existing toilet. During installation, the base plate of the toilet lift is secured to a common household drain using a wax seal of a known type, and securely connected to the floor using screws, fasteners, or the like. For integral units, the top plate would be integrally formed with the base portion of a toilet. For units which are attached to an existing toilet, the top plate is welded, glued, fastened, anchored, bolted, or screwed to the bottom of the toilet, with the drain outlet of the toilet placed over the bore of the top plate and connected to the drain extension. A wax seal may be installed between the top plate and the bottom of the toilet in this application to ensure no leakage occurs.

Figure 19:
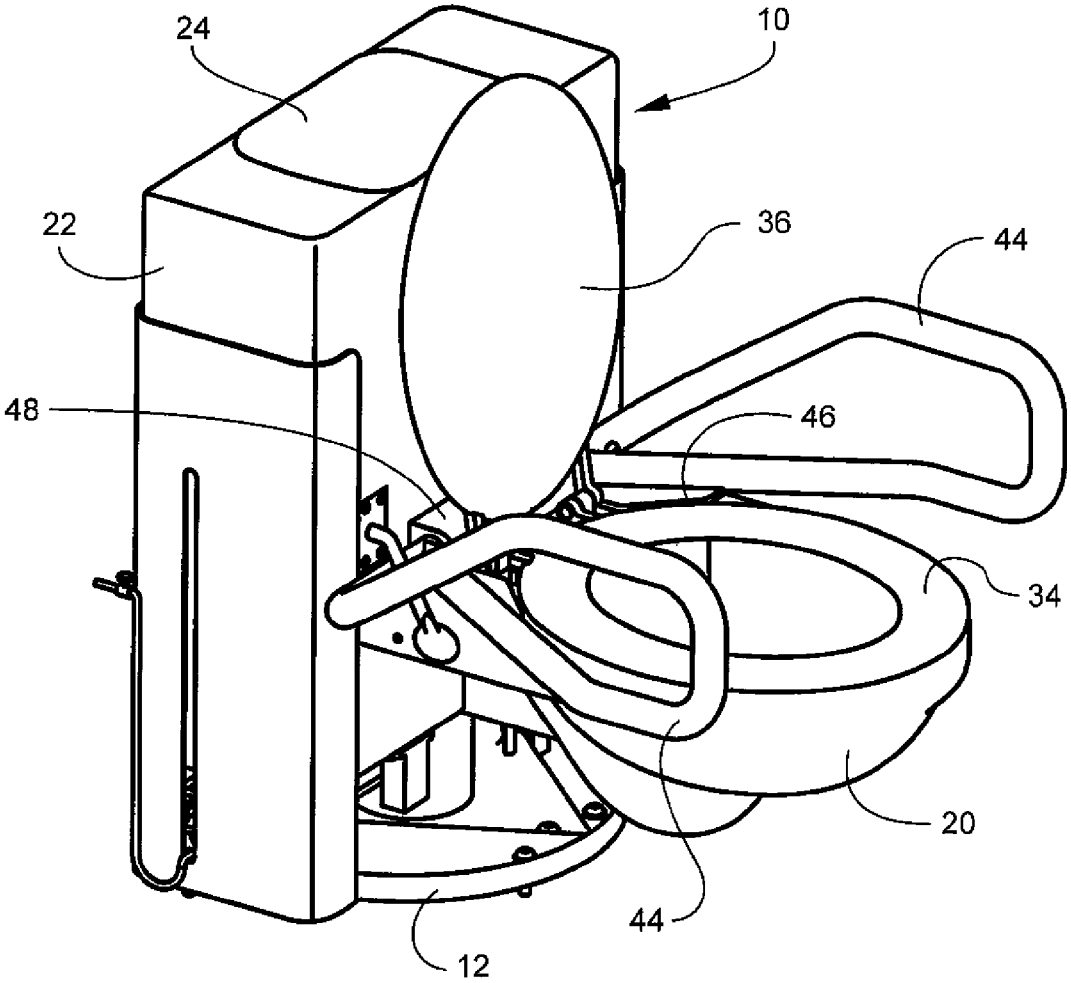
FIG. 19 is a perspective view of a side rail system mounted to the adjustable toilet of FIG. 1, according to one implementation.
Figure 20:
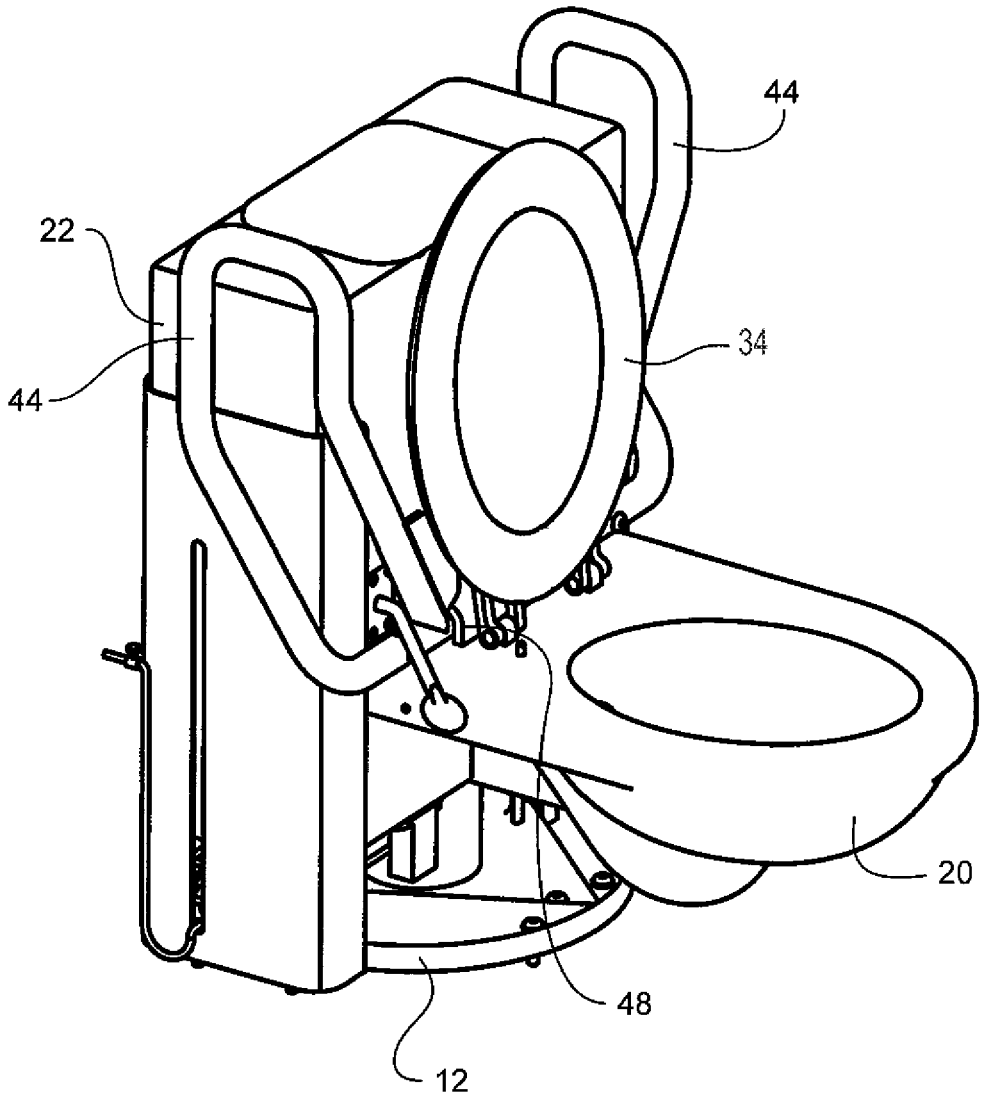
FIG. 20 is a perspective view of the side rail system of FIG. 19 shown in a raised or stored position.
Figure 21:
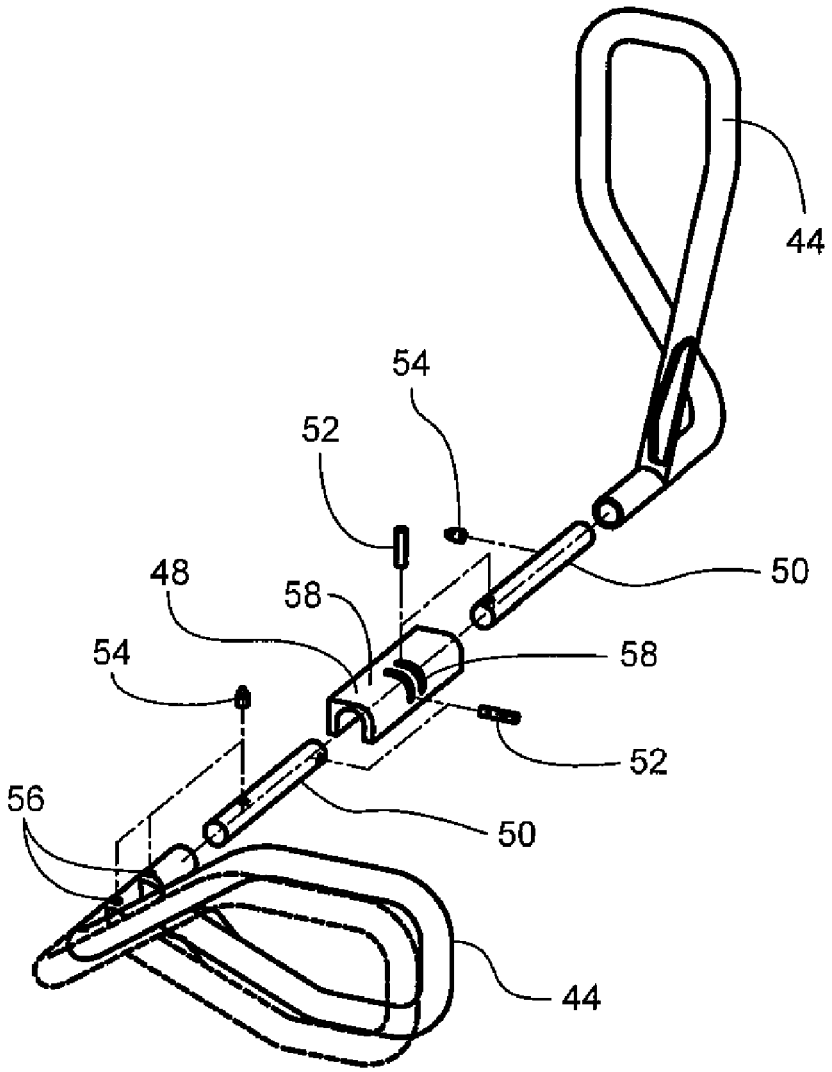
FIG. 21 is an exploded view of the side rail system of FIG. 19.

FIG. 19 is a perspective view of an embodiment of a side rail system mounted to a toilet, and in some implementations may be mounted to the adjustable toilet 10 of FIG. 1. In addition, FIG. 20 is a perspective view of the side rail system shown in a raised or stored position. FIG. 21 is an exploded view of the side rail system and FIG. 22 is a perspective view showing the range of motion of the side rail system.

The side rails 44 of the side rail system may be used for supporting a user and can assist the user while getting onto or off of the seat 34. In FIG. 19, the side rails 44 are shown in a lowered or operating position. The side rails 44 bear on the toilet bowl 20 with attached rail plates 46. In FIG. 20, the side rails 44 are shown in a raised or retracted position. The side rails 44 are pivotally mounted in a rail pivot block 48, which in turn is mounted onto the toilet housing 18.

A pair of rail pivot shafts 50, the rail pivot block 48, and centering pins 52 are shown in FIG. 21. Centerlines indicate how the different parts are fitted together. Each side rail 44 can be raised or lowered independently by pivoting with its rail pivot shaft 50, and can be slid inward or outward along its rail pivot shaft 50, to facilitate mounting and dismounting of the toilet 10. Spring-loaded ball plungers 54 mounted in the rail pivot shafts 50 serve to lock the side rails 44 to the desired width, in cooperation with holes 56 in the side rails 44. It is understood that other common fastening methods can be used for permanent or temporary locking the side rails 44 onto rail pivot shafts 50. A slot 58 in the pivot block 48 receives the centering pins 52 to assure that the side rails 44 are held in place in the pivot block 48.

Figure 22:
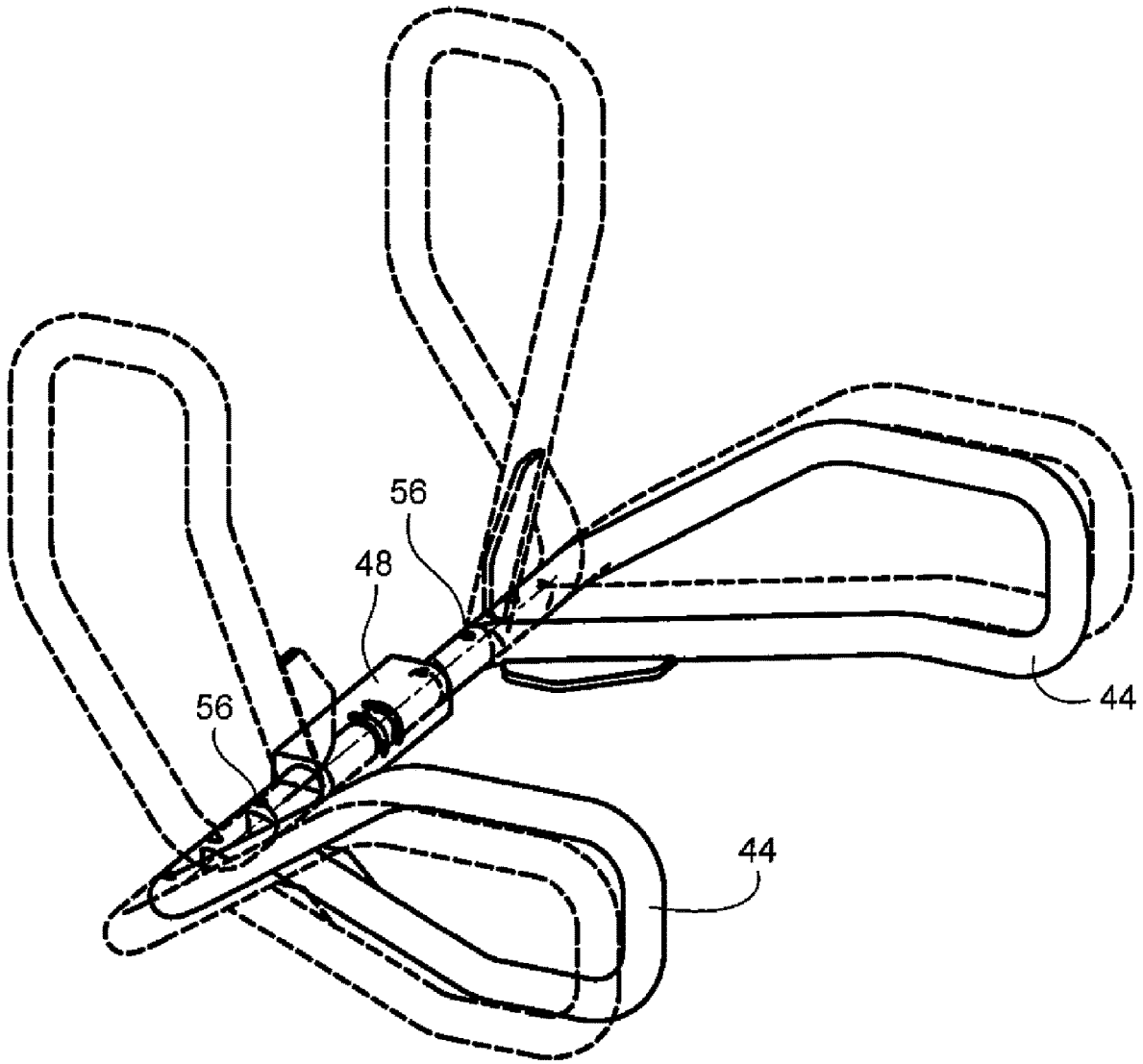
FIG. 22 is a perspective view showing the range of motion of the side rail system of FIG. 19.

FIG. 22 shows how the parts fit together and how a user can select appropriate holes 56 in the side rails 44 for adjusting the side rails 44 to a desired width. The dotted lines show the outermost positions of the side rails 44 as well as their up and down positioning.

Figure 23:
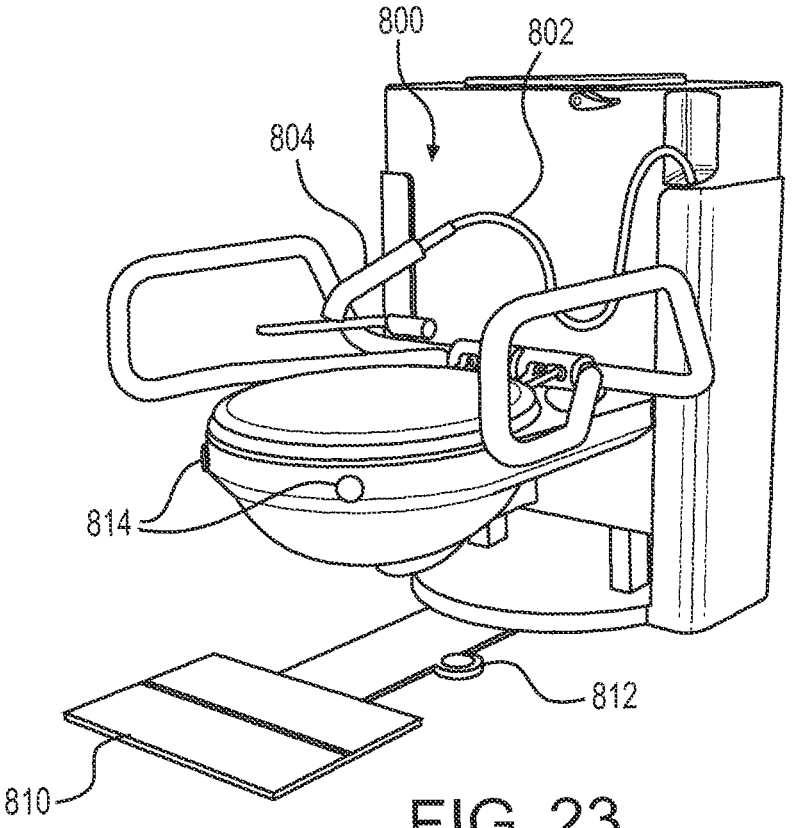
FIG. 23 is a perspective view of a toilet having a bedpan sprayer system and a foot pedal, according to various implementations of the present disclosure.
Figure 24:
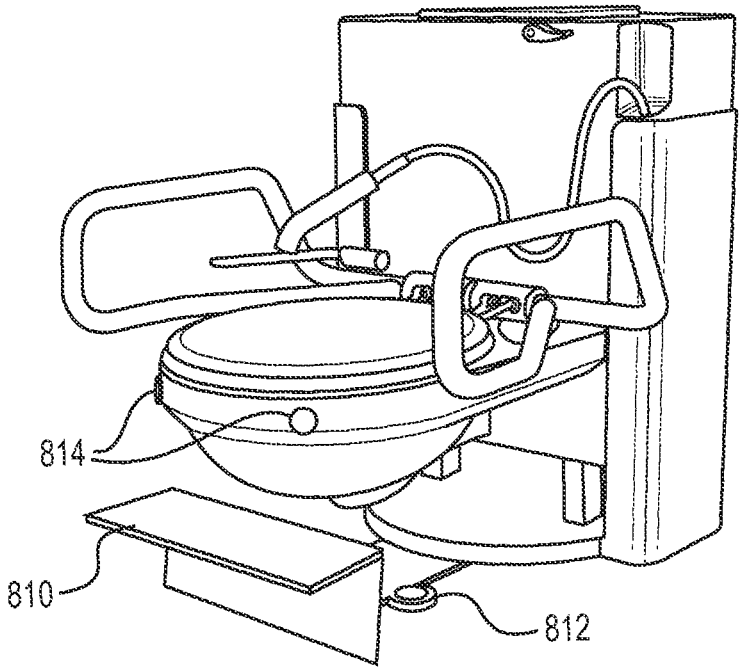
FIG. 24 is a perspective view of the toilet of FIG. 23 shown with the foot pedal in a lifted state.

FIG. 23 is a perspective view of a toilet showing various embodiments of a bedpan sprayer system 800, a foot lift 810, and a foot pedal 812. As shown in FIG. 23, the the foot lift 810 is in a flat position against the floor. FIG. 24 is a perspective view of the toilet of FIG. 23 shown with the foot lift 810 in an elevated state. The foot lift 810 may include hinged platforms that are controlled to position the platforms in the flat position or the elevated position.

In some embodiments, the positioning of the platforms of the foot lift 810 may be controlled by pressing the foot pedal 812. According to other embodiments, the foot pedal 812 may be used to actuate one or more other functions, such as raising or lowering the height level of the seat 34. The foot pedal 812 may also be used to automatically flush the toilet, reset the height of the seat 34 to a predetermined level, automatically close the lid 36, and/or other functions. In still other alternatives, the toilet may include one or more additional actuators 814 for controlling one or more of these various functions.

The toilet may use an actuator (e.g., pedal 812, actuators 814, etc.) requiring an external power source (e.g., electric, air, or hydraulic motor) connected to the actuator. Other types of actuation may include a wall-mounted joy stick or other similar control mechanism. The user is able to operate the external power source using the controller to adjust the toilet to the desired height and/or to perform other functions.

In some embodiments, the actuators 814 may be implemented as sensors for sensing various parameters. For example, a toilet function may be controlled remotely by a motion sensor 814 disposed near a toilet and interconnected to a centrally located server, which may in turn be connected to an external power source. The centrally located server includes a preset initial height stored therein. When the motion sensor 814 is activated by an individual approaching the toilet, the server automatically activates the external power source to adjust the toilet to the preset initial height.

Figure 25:
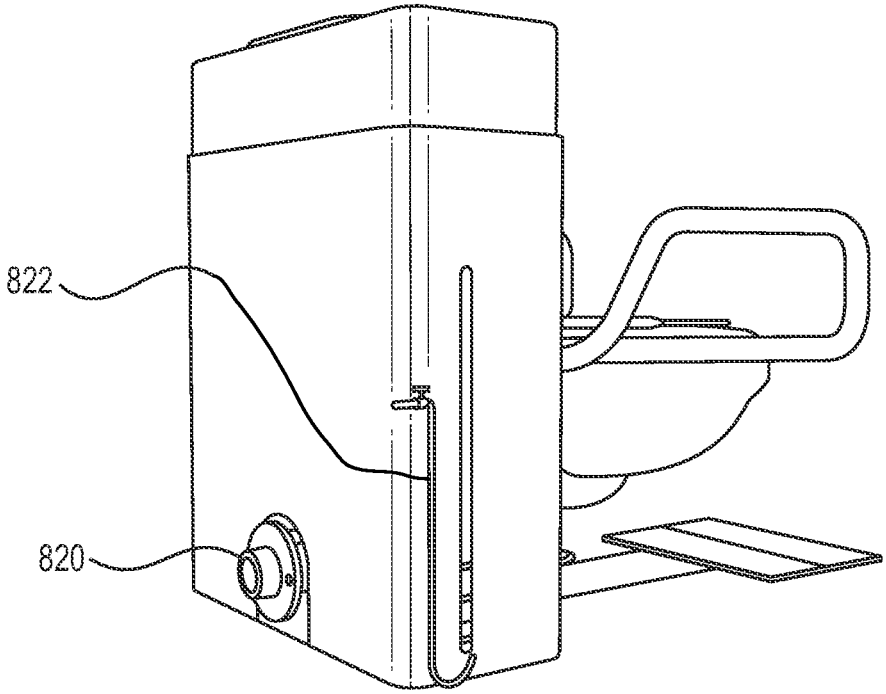
FIG. 25 is a perspective rear-side view of the toilet of FIG. 23 having a wall-oriented drainage system, according to one implementation.

FIG. 25 is a perspective rear-side view of the toilet of FIG. 23 having a wall-oriented drainage system. For example, the toilet may include a flange mount toilet horn 820 for connection with the drainage system. The toilet may also include a wash hose 822 configured to receive clean water from a water supply. The wash hose 822 may be used for cleaning body parts of the user and/or for cleaning the toilet itself or the floor surfaces around the toilet.

Figure 26:
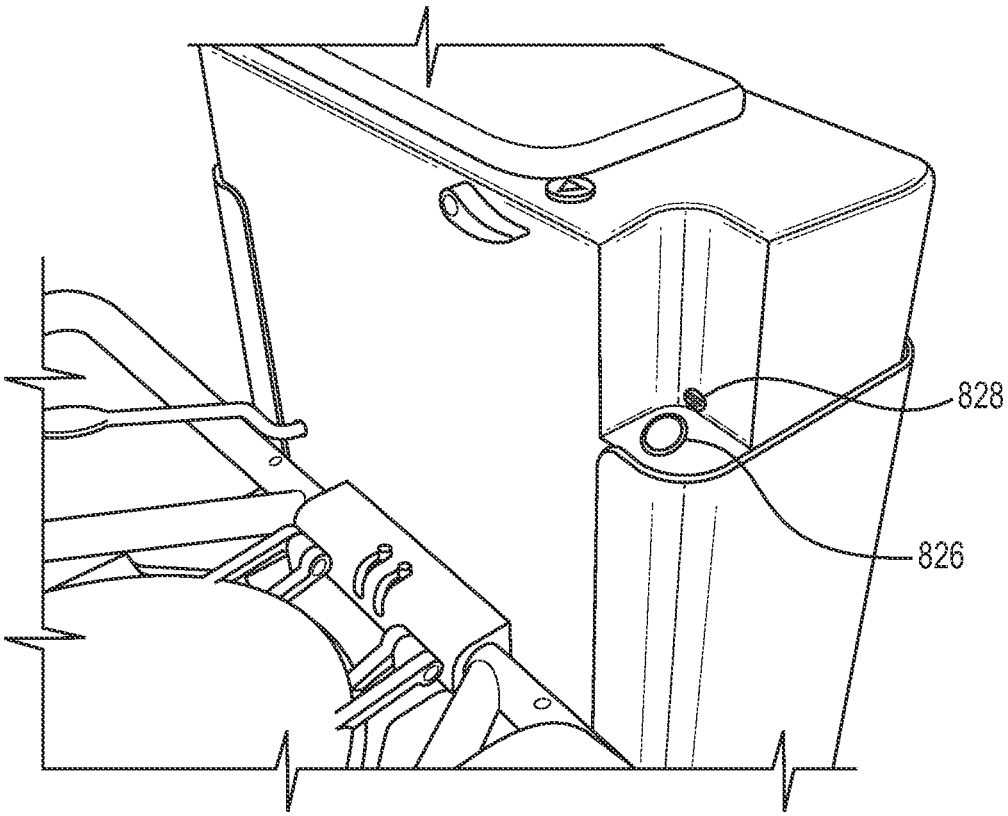
FIG. 26 is a perspective view of a portion of a toilet having a night light and automatic air freshener, according to various implementations.

FIG. 26 is a perspective view of a portion of a toilet having a night light 826 and automatic air freshener 828, according to various implementations. The night light 826 may be connected to an electrical power source to allow the user to be able to use the toilet at night or when the bathroom is dark. The automatic air freshener 828 may be configured to automatically spray a mist of air freshening solution into the air when the toilet is flushed, when the toilet detects that the user has sat down on the seat 34, and/or at other times when air freshening may be needed.

According to additional embodiments of the present disclosure, the toilets described above may include any combination of electrical circuits for sensing parameters, capturing images, communicating electrical signals related to sensor data, transmitting signals to routers or other electrical terminals by Wi-Fi connectivity, communicating with remote servers via the Internet or over other networks, and other electric capabilities. Thus, the toilets may be provided with sensors (e.g., proximity sensors), cameras, infrared cameras, Internet connection devices, Wi-Fi equipment, voice recognition sensors, and/or other electrical circuitry for performing, assisting, or prompting the functions described in the present disclosure. As an example, a camera may be used to capture facial features of a user, whereby facial recognition software may be used to determine the identity of the user and actuate an automatic height adjustment function for that particular user. According to another example, a proximity sensor may detect when a user has moved off the seat 34 and may then prompt an automatic flushing action.

Figure 27:
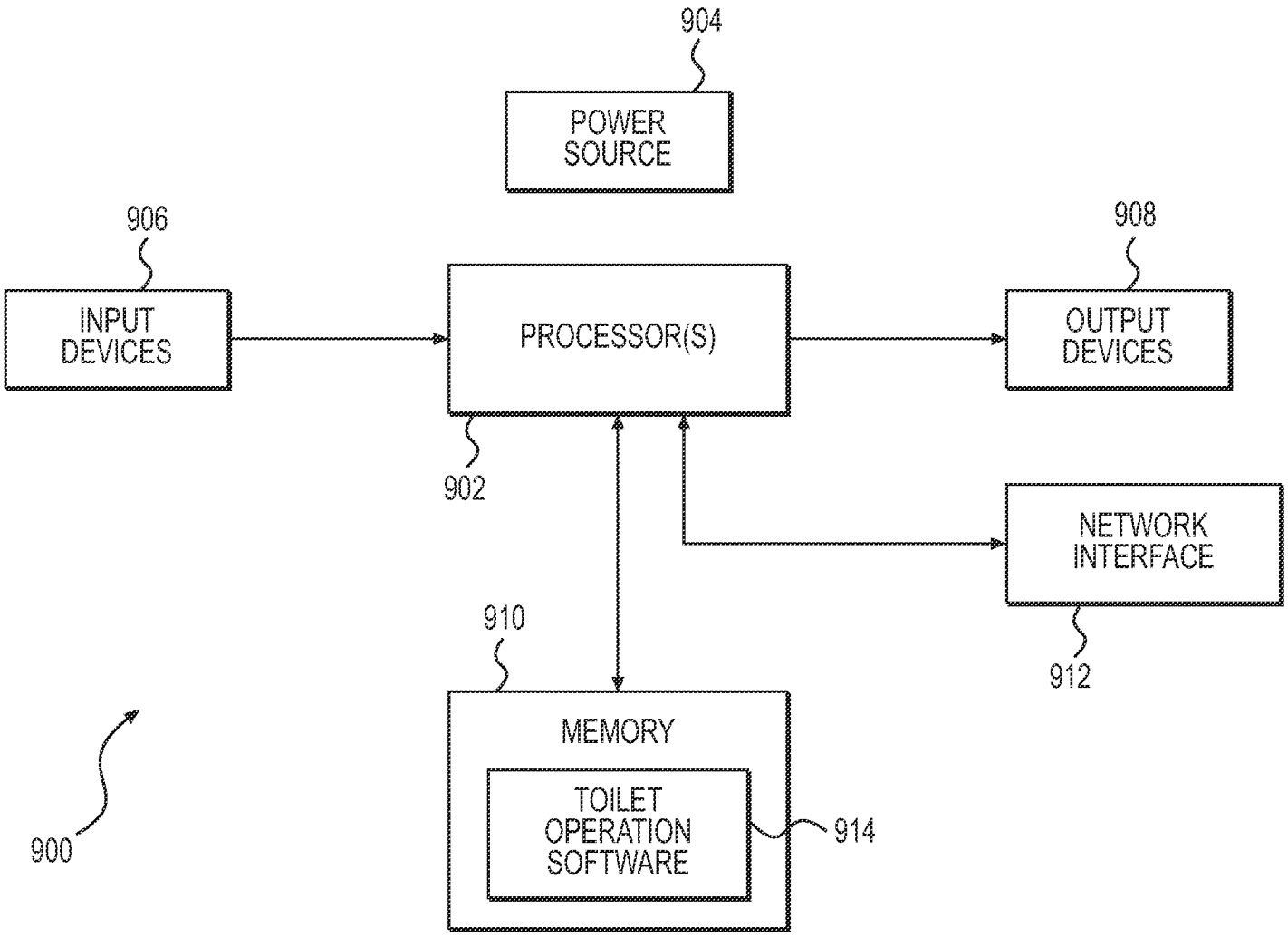
FIG. 27 is a block diagram illustrating a control circuit for controlling the operation of a toilet, according to various implementations.

FIG. 27 is a block diagram illustrating an embodiment of a control circuit 900 for controlling the operation of a toilet, such as the toilet 10 of FIG. 1 and/or the toilet shown in FIG. 23. The control circuit 900 includes one or more processors 902 and a power source 904 that provides power to the processors 902 and other components of the control circuit 900. The control circuit 900 further includes input devices 906 and output devices 908. Also, the control circuit 900 includes a memory 910 and one or more network interfaces 912 for connections with external networks (e.g., the Internet, cellular networks, etc.). The memory 910 may be configured to store toilet operation software 914 for controlling the operations of the toilet.

Figure 28:
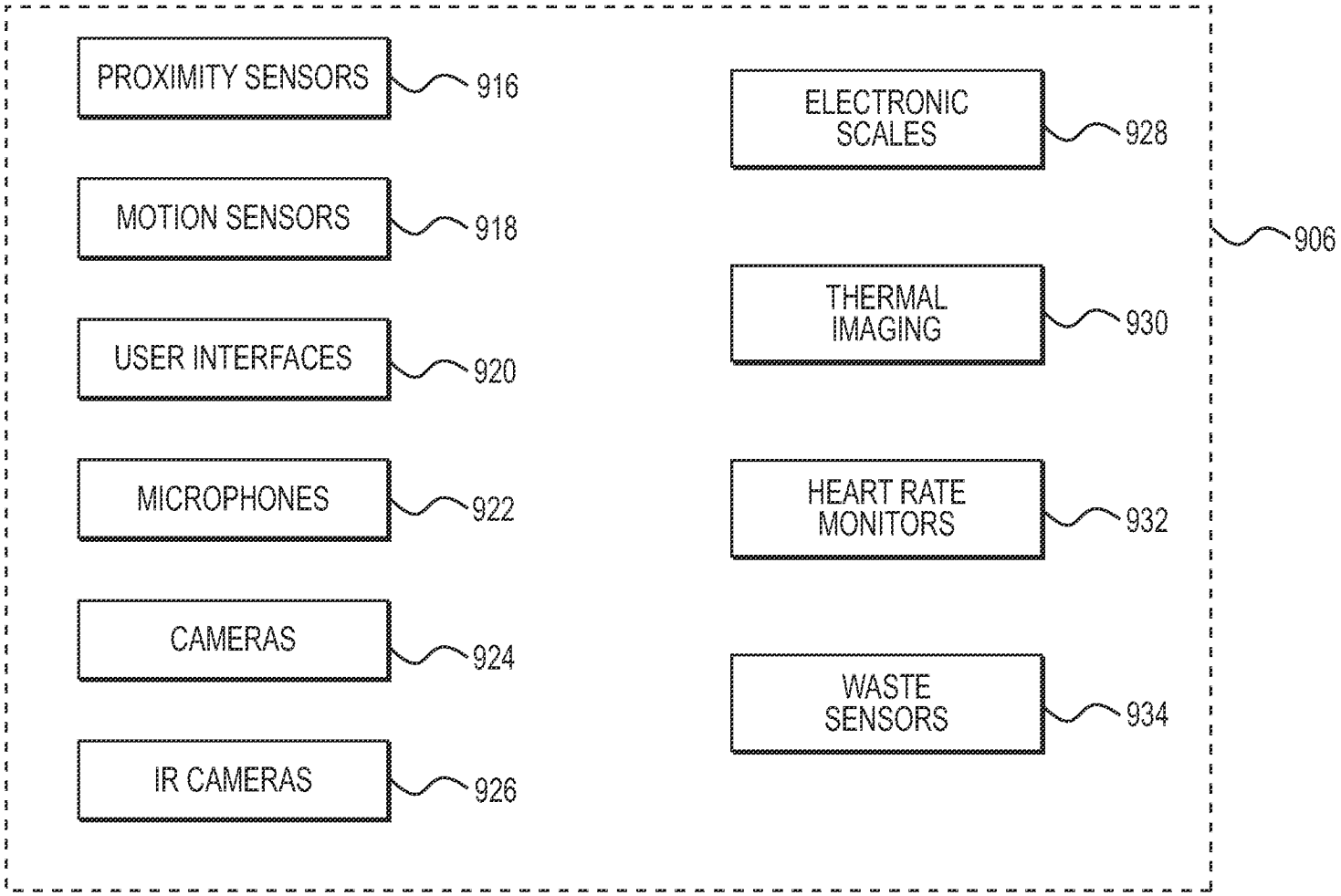
FIG. 28 is a block diagram illustrating the input devices shown in FIG. 27, according to various implementations.

FIG. 28 is a block diagram illustrating embodiments of the input devices 906 shown in FIG. 27. For example, the input devices 906 may include one or more of the devices shown in FIG. 28 and/or other similar devices for receiving input signals that can be processed by the processors 902 to control various aspects of the toilet. As illustrated in FIG. 28, the input devices 906 may include proximity sensors 916, motion sensors 918, user interfaces 920, microphones 922, cameras 924, infrared (IR) cameras 926, electronic scales 928, thermal imaging devices 930, heart rate monitors 932, and waste sensors 934.

Figure 29:
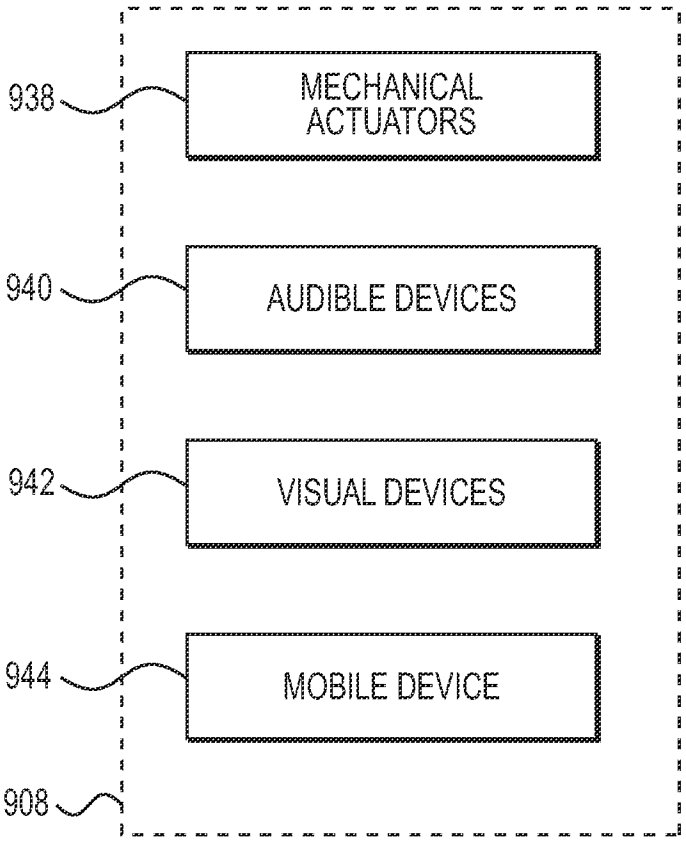
FIG. 29 is a block diagram illustrating the output devices shown in FIG. 27, according to various implementations.

FIG. 29 is a block diagram illustrating embodiments of the output devices 908 shown in FIG. 27. According to various implementations, the output devices 908 may include one or more of mechanical actuators 938, audible devices 940, visual devices 942, mobile devices (e.g., smart phone applications) 944, and/or others.

Figure 30:
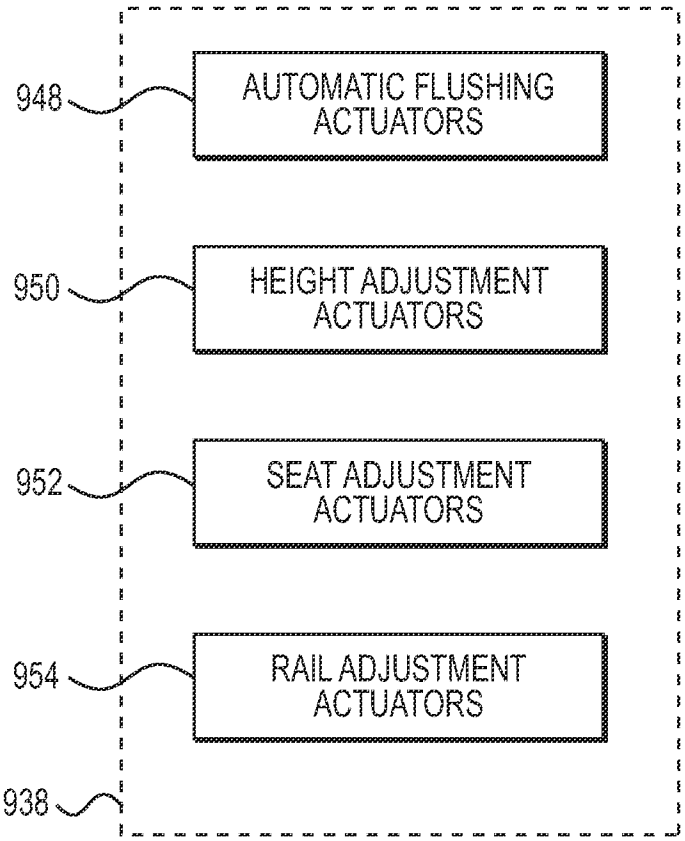
FIG. 30 is a block diagram illustrating the mechanical actuators shown in FIG. 29, according to various implementations.

FIG. 30 is a block diagram illustrating embodiments of the mechanical actuators 938 shown in FIG. 29. For example, the mechanical actuators 938 may include automatic flushing actuators 948, height adjustment actuators 950, seat adjustment actuators 952, and rail adjustment actuators 954, and/or other actuators.

Figure 31:
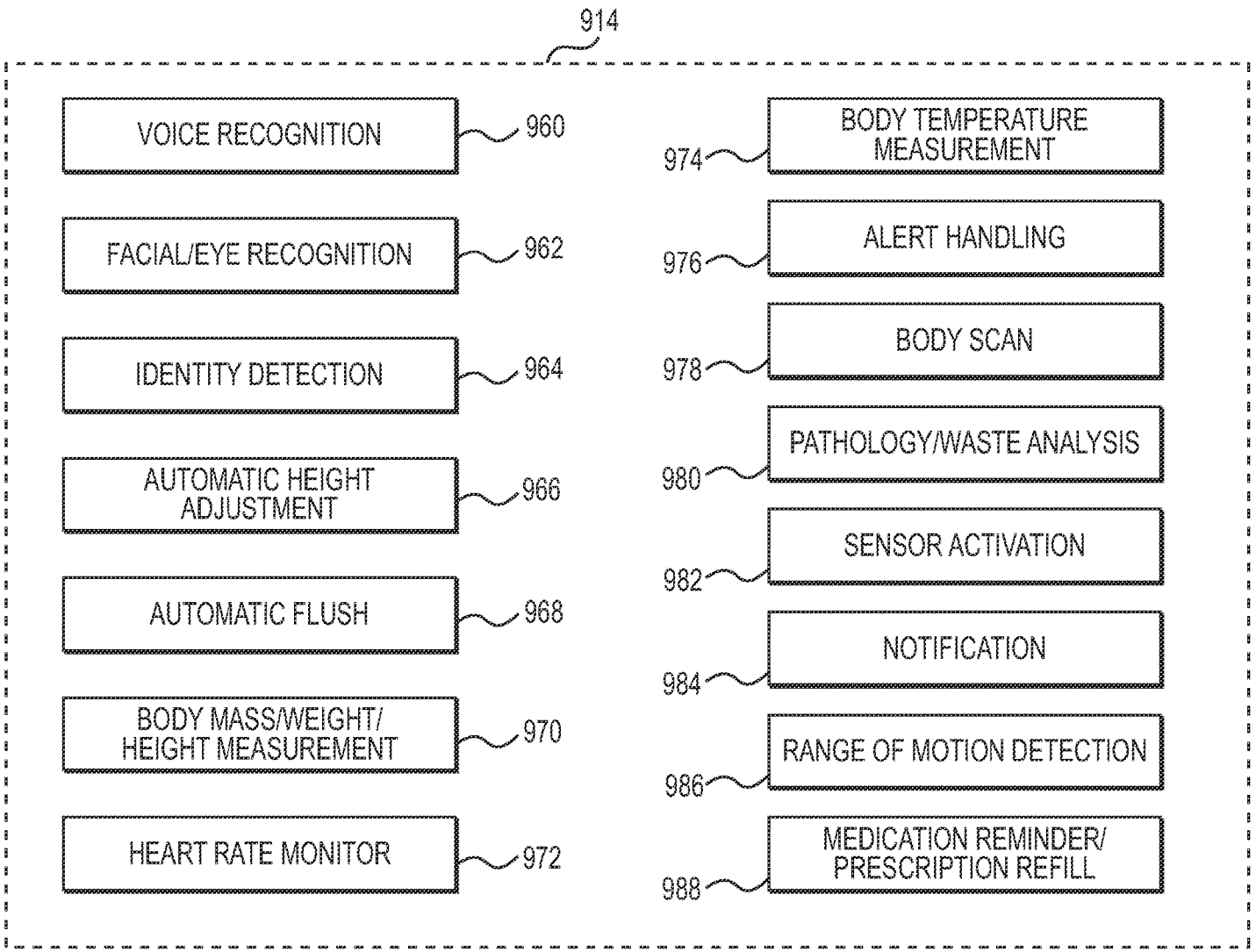
FIG. 31 is a block diagram illustrating software modules of the toilet operation software shown in FIG. 27, according to various implementations.

FIG. 31 is a block diagram illustrating embodiments of various software modules of the toilet operation software 914 shown in FIG. 27. For example, according to some embodiments, the software modules toilet operation software 914 may include voice recognition 960, facial/eye recognition 962, identity detection 964, automatic height adjustment 966, automatic flushing 968, body mass/weight/height measurement 970, and hear rate monitor 972. Other software modules may include body temperatures measurement 974, alert handling 976, body scan 978, pathology/waste analysis 980, sensor activation 982, notification 984, range of motion detection 986, and medication reminder/prescription refill 988. Any one or more of the software modules shown in FIG. 31 may be used alone or in combination with other modules to allow the processor 902 to perform various toilet control actions as described above.

There can be a multitude of sensors 906 used that may include different functions. Motion sensors 918, Wi-Fi devices 912, and cameras 924 with infrared capabilities 926 can be integrated into the sensors. These devices 906 may have their own power source 904 and may also have a manual override system.

Thus, with various sensors 906 and one or more processing devices 902 (e.g., microprocessor, microcontroller, central processing unit, etc.), the toilets described in the present disclosure may be able to perform additional functions, such as measure body mass 970 of the user, detect a user's height 970 and automatically adjust the height 966 of the seat 34 according to the user's height allowing for maximum comfort and ideal body position whether the user is sitting or standing, utilize voice recognition software 960 to respond to voice commands, facial recognition software 962, and even eye/iris recognition software 962.

Some sensors 906 may include body temperature reading 930, 974 and assessment capabilities. Other sensors may detect motion 918 or detect if a user has fallen, which may result in handling alerts 976 to doctors, nurses, family members, etc., and may include notification 984 to the user or to medical professionals as needed.

The toilets equipped with electrical circuitry (e.g., control circuit 900), as described herein, may implement Wi-Fi capabilities of a network interface 912 to communicate with a router or other network device to allow the use of an application designed for medical personnel in a hospital or other health care center and/or for remote special care monitoring. The toilets described herein may communicate to medical personnel to inform 976, 984 nurses or doctors of various conditions, such as a user who has fallen from the toilet. This information may also be remotely communicated to medical personnel as needed. Remote control of the toilet may allow activation of the water valve systems of the toilet to flush 968 from outside the bathroom.

In accordance with some embodiments, the toilet may be equipped with 3D imaging. The toilet may be configured to activate the 3D imaging system using cameras 924. Some cameras 924 may be used to produce a hologram image 942 that will allow one to communicate to a visible responder.

Multiple sensors 906 may be placed at various points around the toilet to detect various angles of the users and/or urine and bowel movements. Because of the multiple placements of the sensors and the adjustability of the toilet height, full or partial body scans may be performed 978 as the toilet is adjusted up and down. The user (or remote medical staff) may request a body scan 978, such as by pressing a button 920 on the toilet, and the body scan cameras 924 and other electrical hardware/software may perform the scan function 978 and provide a read out in audible 940 or visual 942 forms. In some embodiments, body scan information may be provided to an application on a user's mobile device 944 (e.g., smart phone).

Some sensors 906 may include microphones 922 (e.g., waterproof microphones) or other audio input devices to receive voice commands. Thus, someone may give specific orders to the toilet, such as to operate a variety of functions, without the need to touch the toilet or buttons or other input components on the toilets. Audio signals may also be received 922 by the sensors regarding a user's desire height, and in response the automatic raising or lowering devices 950 may be used to adjust the height as commanded.

Voice commands 960 may also be used to adjust a four-way integrated railing system 954 isometrically or individually (right or left side rails 44). It can adjust out of the way of an abled body person that has no need for them or they can adjust to the commands of a handicap, disabled, or a recent surgery recipient, that wishes to move the rails, up, down, expand them out or in for their comfort, without the need to do it manually. Voice commands 922 may also be used to allow the user to raise or lower the toilet seat/lid 952 hands free, to flush the toilet 948 hands free.

Audio components may be functional through a voice recognition 960 response and can be activated or shut down by voice recognition 960. In some implementations, safety scripts may be embedded into the software 914, including words to avoid any perceived dangers to children, elderly, disabled, and others.

Within the application 944, there is a single switch interface that will allow one to build complete sentences, giving commands to a speech synthesizer program of the toilets. It may also be used as a benefit for those who only can use eye movement 962 for communication. For example, it may allow response to a first care operator by detection of the up, down, left, or right movement of the occupant's eyes.

It is noted that the toilets described herein may recycle the water used for adjusting the height to also be used for the flush. The toilets can flush automatically 948 and reset themselves to the original starting height 950 once the user puts the toilet lid/seat in the down position (manually). Therefore, the command to put the toilet lid/seat down will automatically reset the toilet to its original height 950 and recycle the water for the flush, and then will flush automatically 948. Hence, the systems may operate multiple functions with a single command.

Imaging devices (e.g., cameras 924) may also be incorporated in the toilets or associated with the toilets. The cameras 924 may be activated in the case of emergencies, for first response officers. Sensors 906 may detect if a triggering event has occurred, such as the person has transferred to a chair, stood up, or fallen off of the toilet. If the occupant has fallen off of the toilet, the cameras 924 and microphones 922 will detect such event using software configured to detect such event (such as artificial intelligence (AI)) and then, in response to detecting the triggering event has happened, activate automatically to a first response officer. This will allow the officer to have hands free communication (via a cell or voice-over-IP (VoIP)) communications to the occupant, and get help to the occupant as quickly as possible.

The toilets may use infrared 926, thermal imaging 930, and/or Automatic Temperature Compensator (ATC) capabilities to detect body temperature 974 that could indicate numerous physical conditions, such as fever, swine flu (H1N1), the SARS epidemic, or other ailments. Because the processor 902 may integrate signals to or from the sensors 906, cameras 924, and Wi-Fi devices 912, doctors or medical staff may be notified from the toilet or from a first responder, either in a hospital or at home, for receiving accurate notifications of the user's condition, such as a significant change in body temperature.

Not only will a fall activate 982 the toilet camera, it will also activate one or more of a set of preset cameras through the application on the mobile device 944 (e.g., smart phone, tablet, camera, etc.), while sending out notifications 984 to anyone, such as family or medical professionals. There will also be a video screen 942 activated on the toilet, the screen 942 will be embedded into the toilet's structure behind a clear coat or other protective surface, similar to the way a television may be embedded behind a mirror. The television screen can also be detachable, the screen size may vary, and it may have touch screen 920 technology compatible with any camera 924 linked to it. This will allow for use in safe rooms or storm bunkers.

According to yet another implementation, the toilets described herein may further use a varied external power source 904, such as fuel cell technology that allows the toilet to convert chemical/liquid energy (such as water) from a fuel into electricity through a chemical reaction of positively charged hydrogen ions with oxygen or another oxidizing agent. Other types of fuel cells can also be integrated into the toilets described herein. This will also allow for operation with use of minimum water in any location where there may be no electricity, such as outer space. Zero gravity energy can also be used as an external power source 904, along with battery, electrical outlet and cord. Any of these sources can be combined into one toilet system.

The power source 904 may be located in the toilet housing 18 and toilet bowl 20, and may be attached to the side rails 44 to the toilet. The toilet block or toilet housing, regardless of its material, can be a housing unit for the power source 904, even if the side rails 44 are not inserted into the block. The rails 44 can be installed at any time and will be activated when installed with the block, with infrared technology, and or any desirable power source.

The application software 914 configured to operate on a mobile device 944 (e.g., smart phone, tablet, etc.) may be designed to assist the medical professionals and the user/patient. All functions on the toilets can be operated from the application 914, which may include the capability of automatically texting 976, 984 regarding the location of the toilet or bathroom for those that are deaf or hearing impaired. Also, the application 914 may automatically send a voice message 940 regarding the location.

The toilet may also include an anatomically correct seating grid 928 to the toilet seat 34 that may be more comfortable for a patient who has received a surgical procedure to the lower back, lumbar area, hip, knee, or ankle. The toilet may include the foot lift 810, which may include a retractable sensor pad 928 that the user can stand on allowing the user to start from a standing position and then gradually lower themselves to a position of maximum pain tolerance. Once they have reached their maximum pain tolerance, they can then enter 920 the information from the seating grid 928 into the application (app) 914, or plug a cable from the toilet into the mobile device 944 to provide information to the app, or alternatively may provide information through the voice recognition software 960. The app 914 will then take all the calculations and put them into an algorithm to determine the patient's range of motion 986 at the time. This information may be relayed 984 to the patient's caretaker, doctor, or nurse. This will save time on making multiple trips to the doctor's office to check on one's progress. With the camera functions, the doctor will be able to monitor the healing process.

The toilet can also be set up, such as through an app reminder system, to take medications 988 at specific times, such as for diabetic management, hypertension, birth control, thyroid issues, osteoporosis, prostate, kidney, congestive heart failure, etc. After the medication is taken, the user can disarm the notification until the next dose is required, if the dose is only to be taken for a set amount of days. The user's doctor, nurse, or pharmacist can set the exact amount of days on the app and notify the user to refill a prescription 988, which can be done securely on the app, and can be delivered directly to the user's residence who may be homebound. This can also save time for both the patient and the medical professionals.

The foot lift 810 may also be configured as a scale 928 for detecting body mass 970. The app 914 may read the weight 970 of a user from the foot lift scale 810 and/or from an integrated scale 928 located in the seat 34. If a weight is measured while the user places their hands on the railing system, the toilet can measure a body composition to get a reading that indicates what the user's body may be lacking and what their body needs. The processor 902 may be configured to calculate body fat, body mass index, vital signs, and overall health and conditioning 970, 972, 974. That information may be transferred to any wired or wirelessly connected devices, and will allow the user to share information with their doctor, nurse, or caregiver.

In some embodiments, the railing system may include side rails 44 that have integrated sensors for testing heart rate 932. These sensors 932 may use their own external power system 904 and/or may connect to the toilet's power system, allowing a fully functional integration with the voice recognition capabilities 960, and the application sources.

The user may also be able to adjust the toilet's height manually through the integrated railing system, using Wi-Fi or touch processes 920. One touch process 920 may include touching a top rail portion to move the toilet up, touching a bottom rail portion to move the toilet down, and taking hands off the rails completely to stop the movement of the toilet. These actions may operate on a sensor basis and may be configured to operate if touched on certain areas of the rails.

The rails 44 may also be configured to include electrocardiogram (EKG) sensors 932. The processors 902 of the toilet may be configured to test and record the heart's electrical impulses 972 to create an electrocardiograph, a reading that helps physicians learn more about the heart. It uses the heart's natural electricity to record data, so the procedure can be done in a noninvasive manner in or outside of a hospital, clinic, or medical setting.

At times, urine tests may be needed using waste sensors 934. In some cases, urine tests 980 may be performed to determine drug or alcohol measures in legal situations. In legal cases, a defendant may be required to take a drug and alcohol test, or for medical professionals to test urine or feces. This tester for sensing waste products 934 can be built into the toilets described in the present disclosure. The tester 934 may alternatively be attached to an existing toilet bowl.

Urine tests 980 can be used to report a basic diagnostic to determine pathological changes in one's urine. The test will function in the same capacity as a urine test strip that may comprise up to 10 different chemical pads or reagents, which react to color change when removed from a urine sample. However, there are ways that a person can cheat the test and use someone else's "clean" urine or feces as a substitute for their own.

With the present implementations, the toilet may be configured to prevent fraudulent tests. For example, the toilet may determine the identity of a person using one set of sensors 964, while another set of sensors 934 may be used in parallel to detect the urine sample. In this way, the toilet can read who the subject is and receive a sample from only that subject. Once the subject is identified, the subject must not leave the sensor area of the toilet, but must sit down on the toilet. In some implementation, the subject may further be recorded from the back. These safe guards may be used so that the subject cannot use another person's urine. For example, once seated, the subject may be required to place both hands on the side rails 44 having identity sensors, and must stay in contact with the rails 44 until the subject has completed urination. This method safeguards against the subject pouring another person's urine over a test strip into the toilet. Also, sensors may be used to detect the presence 916 of another person in close proximity who may be trying to alter the test. If one or more of these requirements is not met, the subject must re-test.

In some embodiments, the urine dipstick 934 may automatically deploy from a back portion of the bowl 20 for a female or from a front portion of the bowl 20 for a male. The dipstick 934 may be situated high enough that it is not affected by flushing. For an electronic test strip or dipstick 934, once the test is completed, there is no need for the subject to do anything else. Since the test strip is electronic in this case, it will clean itself for the next test and retract itself back into the bowl. The strips may be interchangeable depending on what test may need to be administered.

Various embodiments of the above-described toilets may be employed. For example, some toilets may be configured with all the features and components described herein, whereas other toilets may have only one or more features/components to perform just one or more function. In some cases, an existing toilet may be modified to include one or more of the features described herein or may include an add-on component or components as needed. For example, attachments may be purchased individually or as sets. These toilets and accessories may be more useful for medical professionals, such as in hospital settings, since the toilets described herein allow for a wide range of diagnostic tests of various diseases and body characteristics. The analysis software 914 and processing may be directed for testing any types of diseases or conditions of a human body, such as the detection of the presence of proteins, glucose, ketones, haemoglobin, bilirubin, urobilinogen, acetone, nitrite, leucocytes, etc. Also, the toilet may be configured for the testing of PH (probability of Hydrogen), specific gravity, or to test for infection by different pathogens.

Feces can also be tested 934 as it relates to checking the digestive system, diet, bacteria, and a general health assessment. A stool scale incorporated in the toilet may also be configured to break down the feces into seven categories, which can be analyzed 980 by medical professionals. Analysis of feces 980 may include detection for watery, liquid feces having no solid stool pieces. Also, analysis may include detecting separate hard lumps (such as nuts that may be hard to pass), fluffy pieces with ragged edges, a mushy type stool, sausage shaped lumpy stool, sausage-like but with cracks on the surface, soft blobs with clear-cut edges, sausage or snake like have a smooth and soft texture, etc.

The testing apparatus 906 of the toilets may also be configured to test feces 934, 980 for color, odor, average chemical characteristics, abnormalities, parasites such as pinworms and their eggs. The apparatus can also be used for the detection of disease spreading bacteria. The main pathogens that may be considered are bactericides, *Salmonella, Shigella, Yersinia, Campylobacter, E. coli* O157, *Cryptosporidium, Entamoeba histolytica*, undigested food remnants, diarrhea, constipation, and bile.

As mentioned above, the toilets may be equipped with electrical systems 900 for processing sensor signals 902 and communicating sensor signals with other parts of the toilets and/or with remote terminals (e.g., via network interfaces 912) being monitored by medical professionals. The electrical systems 900 may include biometrics 970, 972, 974 which are used for measurements and statistical analysis of a person's physical and behavioral characteristics. The system may then provide an electrical respond to various stimuli in a reactive manner, which allows the toilet to prompt certain actions or responses 908. The systems may be used to rouse activity or energy which can be stored and used when called upon. This will allow for a more rapid response time.

The electrical systems 900 of the presently described toilet systems may also be configured to acquiesce to the prompts or triggers. The systems may comply with commands 920, 922 to allow the toilets to communicate various actions via remote access and/or wireless connection. The toilets can receive information from sensors 906 and perform internal processing 902 to calculate various parameters 908 or can communicate externally 912 for outside processing and analysis. The processors 902 and associated software 914 may be configured with intelligence to vary the state of physical structure and/or can take action in response to varying situations. These actions can be based on varying requirements, past experience, or artificial intelligence. The systems may incorporate one or more microprocessors 902 having their own processing capability.

Additionally, the electrical systems 900 may include a nervous system or complex collection of hardware 902, 910, software 914, and/or firmware, along with specialized wired and/or wireless sensors 906 to measure parameters and receive commands, and then act upon the sensed data and commands. The systems act as nerves and neurons that transmit signals between all the functional parts of the toilet and electrically connects the various parts of the electrical system together. In some embodiments, the neural connections may be configured without actual electrical wires.

The processing system 902 may include a motherboard, which may be the central command center for the electrical systems, allowing the systems 900 to function properly. The motherboard may serve to connect all of the parts of the functions of the toilet together. Processors 902 may include one or more central processing unit (CPUs), memory 910, hard drives, optical drives, video card, sound card, and other ports and expansion cards all connected to the motherboard directly or via cables.

With the use of fuel cell or zero gravity energy power sources connected to the motherboard, the embodiments of the toilets described herein can generate power from the most minimal sized fuel cell, such as an AA cell battery. Although the fuel cell will produce waste in the form of carbon dioxide, heat, and water, the water can be recycled to cool the fuel cells, therefore not requiring the use of excess water from the toilet tank. This allows the toilet to operate from its own independent power sources without producing pollutants.

According to one embodiment of the present disclosure, a toilet lift 950 for adjusting the height of a toilet is provided. The toilet lift 950 may include a base plate attached to a floor and having a lower bore therethrough, a top plate disposed over the base plate, the top plate adapted to carry a toilet body thereupon and having an upper bore therethrough. The toilet lift 950 may also include a lifting mechanism disposed between the base plate and the top plate. The lifting mechanism is operable to move the top plate from a lowered position adjacent the base plate to a raised position spaced-away from the base plate. Further disposed in the toilet lift 950 is a drain extension conduit connected to the first and second bores, the drain extension conduit arranged to allow discharge from the toilet to pass from the upper bore to the lower bore regardless of the position of the top plate.

According to another embodiment, the lifting mechanism may include a plurality of variable-length actuators disposed between the base plate and the top plate. The lifting mechanism may include at least once scissor frame jack disposed between the base plate and the top plate. The lifting mechanism may comprise a first rod with its upper end pivotally connected to the top plate and its lower end disposed in rolling contact with the base plate. The lifting mechanism may further comprise a second rod with its lower end pivotally connected to the top plate, its lower end disposed in rolling contact with the top plate, and its central portion pivotally connected to the first rod. Also included by the lifting mechanism is an actuator connected to the base plate and the lower end of the first rod and operable to move the first rod along a generally horizontal axis so as to cause the first and second rods to lift or lower the top plate.

According to another embodiment of the present disclosure, the base plate includes at least one side portion which hides the lifting mechanism from view. According to another embodiment, the toilet lift further includes a motion sensor operable to determine the presence of a user and to cause the lifting mechanism to raise the toilet to a predetermined height in response thereto. According to another embodiment, the toilet lift further includes a toilet having a bowl and a base plate, wherein the base plate is integral with the top plate.

In accordance with another embodiment of the present disclosure, an adjustable height toilet includes: a toilet base for being attached to a floor; a toilet housing carried by the base and moveable up and down relative thereto, the toilet housing including: (i) a tank housing including a water tank; (ii) a toilet bowl; and (iii) a flushing mechanism; at least one fluid lifting cylinder disposed between the base plate and the toilet housing, the lifting mechanism operable to move the toilet housing from a lowered position adjacent the toilet base to a raised position spaced-away from the toilet base; and a drainage pipe assembly connected to the toilet housing, the drainage pipe assembly arranged to allow discharge from the toilet bowl to pass from the toilet housing to the toilet base regardless of the position of the toilet housing.

According to another embodiment, the lifting cylinder is integrally-formed with the toilet housing. The toilet housing may be received between a pair of opposed side panels extending upwardly from the toilet base. The drainage pipe assembly may include a plurality of concentric pipe segments, the diameter of the segments decreasing from a bottom to a top of the drainage pipe assembly. Each of the pipe segments may include an outwardly-extending flange at its lower end and a resilient ring at its upper end.

According to another embodiment, the adjustable height toilet further includes a lift valve operable to selectively connect the lifting cylinder to: a supply of pressurized fluid, so as to raise the toilet housing; or a drain path to allow fluid to drain from the lifting cylinder, so as to lower the toilet housing. According to another embodiment, the drain path from the lifting cylinder is arranged to discharge into the water tank.

According to another embodiment, the adjustable height toilet further includes: a lid mounted to the toilet bowl and moveable between open and closed positions; and a drain valve operably connected to the lid such that: (i) when the lid is in the open position, the drain valve is closed; and (ii) when the lid is in the closed position, the drain valve connects the lifting cylinder to a drain path to allow fluid to drain from the lifting cylinder, so as to lower the toilet housing.

The adjustable height toilet may further include: a lid mounted to the toilet bowl and moveable between open and closed positions; and a linkage operably connected to the lid such that the flushing mechanism is triggered when the lid is moved to the closed position. The adjustable height toilet may further include left and right side rails mounted to the toilet housing, the side rails individually moveable between a lowered use position and a raised position. The lateral position of each of the side rails may be adjustable so as to vary the width between the side rails.

A preselected volume of water required to raise the toilet housing from the lowered position to the raised position may be substantially equal to a preselected volume of water stored in the water tank to flush the toilet bowl. The adjustable height toilet may further include an adjustable stop carried by the toilet housing for preventing motion of the toilet bowl below a preselected lower limit. The adjustable height toilet may further include an adjustable stop carried by the toilet housing for preventing motion of the toilet bowl above a preselected upper limit.

Thus, adjustable toilets and lifts for toilets are described above. Various details of the toilets may be changed without departing from the scope of the present disclosure. Furthermore, the foregoing description of the embodiments are provided for the purpose of illustration only and not for the purpose of limitation.

What is claimed is:

1. A toilet comprising:
- a bowl configured to flush waste deposited in the bowl;
- a computer processor;
- an image sensor configured to take images proximate to the toilet of a person;
- memory configured to store modules, wherein the processor is configured to, when running a first module:
  - detect movement of eyes of the person;
  - determine an eye movement vector direction indicating a change in direction of the person's eyes;
  - compare the eye movement vector direction with prestored commands associated with different vector directions; and
  - execute a first prestored command in response to the eye movement vector direction matching the first prestored command.

2. The toilet of claim 1, wherein the processor is further configured to, when running the first module:
- detect the person's eyes pointing towards a first direction and then a second direction in that sequence;
- compare the sequence of the first and then second directions with prestored commands associated with the sequence; and
- execute the first prestored command in response to the sequence of the first and then second directions matching the first prestored command.

3. The toilet of claim 1, wherein the eye movement vector direction comprises any of up, down, left or right.

4. The toilet of claim 1, wherein the prestored command comprises notifying a first care operator that the person needs assistance.

5. The toilet of claim 4, wherein the notifying comprises calling, using a cellular call or a Voice over Internet Protocol call, the first care operator.

6. The toilet of claim 1, wherein the prestored command comprises raising a lid disposed over the bowl.

7. The toilet of claim 1, further comprising a lifting mechanism configured to raise and lower a level of the bowl relative to a floor of a room where the bowl is located, wherein the prestored command comprises raising or lowering the bowl relative to the floor.

8. A toilet comprising:
- a bowl configured to flush waste deposited in the bowl;
- a computer processor;
- an imaging device comprising sensor configured to take images proximate to the toilet of a person;
- a microphone;
- memory configured to store modules, wherein the processor is configured to, when running a first module:
  - turn on a computing system that includes the imaging device and microphone so that the imaging device and microphone are turned on;
  - detect, using one or more sensors, if a triggering event executed by the person has occurred; and
  - automatically activate receiving of data by the imaging device and microphone so that the imaging device and microphone are receiving imaging data and audio data, respectively, in response to detecting that the triggering event has occurred by or to the person; and
  - transmitting data communications between (1) an operating computer and (2) at least one of: the imaging device and microphone over a wide area network so that an operator located remote from the person can have hands free communication with the person to assist the person due to the triggering event.

9. The toilet of claim 8, wherein the triggering event comprises one of: the person has fallen, the person has stood up, or the person has transferred to a chair.

10. The toilet of claim 8, wherein the imaging device comprises a camera.

11. A method of operating a toilet, the method comprising:
- detecting movement, using an imaging device comprising a sensor, of eyes of a person, wherein the imaging device is attached to or associate with the toilet;
- determine, using a computer processor analyzing imaging received from the imaging device, eye movement direction that the person's eyes are moving from a first direction to a second direction;

compare, using the computer processor, the eye movement direction with prestored commands; and execute, using the computer processor, a first prestored command in response to the eye movement direction matching the first prestored command.

12. The method of claim 11, further comprising detecting the person's eyes pointing towards the first direction and toward the second direction in that sequence and a vector representing the change being an eye movement direction vector;

comparing the eye movement direction being the sequence of the first and then second directions with prestored commands associated with the sequence; and executing a first prestored command in response to the sequence of the first and then second directions matching the first prestored command.

13. The method of claim 11, wherein the eye movement direction comprises any of up, down, left or right.

14. The method of claim 11, wherein the prestored command comprises notifying a first care operator that the person needs assistance.

15. The method of claim 14, wherein the notifying comprises calling, using a cellular call or a Voice over Internet Protocol call, the first care operator.

16. The method of claim 11, wherein the prestored command comprises raising a lid disposed over the bowl.

17. The method of claim 11, further comprising a lifting mechanism configured to raise and lower a level of the bowl relative to a floor of a room where the bowl is located, wherein the prestored command comprises raising or lowering the bowl relative to the floor.

* * * * *